US008993941B2

(12) United States Patent
Kataoka et al.

(10) Patent No.: US 8,993,941 B2
(45) Date of Patent: Mar. 31, 2015

(54) INDUCTION HEATING DEVICE

(75) Inventors: Akira Kataoka, Shiga (JP); Takaaki Kusaka, Hyogo (JP); Takehiko Shigeoka, Nara (JP); Eiji Matsui, Osaka (JP); Takeshi Kitaizumi, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 195 days.

(21) Appl. No.: 13/381,492

(22) PCT Filed: Mar. 16, 2010

(86) PCT No.: PCT/JP2010/001852

§ 371 (c)(1),
(2), (4) Date: Dec. 29, 2011

(87) PCT Pub. No.: WO2011/001568

PCT Pub. Date: Jan. 6, 2011

(65) Prior Publication Data

US 2012/0097664 A1 Apr. 26, 2012

(30) Foreign Application Priority Data

Jul. 3, 2009 (JP) ..... 2009-158742

(51) Int. Cl.
*H05B 6/10* (2006.01)
*H05B 6/12* (2006.01)

(52) U.S. Cl.
CPC ..... *H05B 6/1263* (2013.01)
USPC ..... 219/632; 219/608; 219/618; 219/624; 219/677

(58) Field of Classification Search
CPC ..... H05B 6/04; H05B 6/06; H05B 6/12; H05B 6/42; H05B 6/101; H05B 6/105; H05B 6/108; H05B 6/062; H05B 6/1263; B05D 3/0272; B05D 3/0281
USPC ..... 219/600, 608, 618, 624, 632, 677, 623
See application file for complete search history.

(56) References Cited

U.S. PATENT DOCUMENTS 7,041,945 B2 * 5/2006 Aihara et al. ..... 219/622
7,135,661 B2 * 11/2006 Park et al. ..... 219/623

(Continued)

FOREIGN PATENT DOCUMENTS

EP 1936283 A2 6/2008
EP 2028912 A2 2/2009

(Continued)

OTHER PUBLICATIONS

International Search Report for International Application No. PCT/JP2010/001852, dated Jun. 22, 2010, 4 pages.

(Continued)

*Primary Examiner* — Dana Ross
*Assistant Examiner* — James Sims, III
(74) *Attorney, Agent, or Firm* — Brinks Gilson & Lione

(57) ABSTRACT

Plural induction heating coils for inductively heating to-be-heated object are provided under a top plate on which to-be-heated object is placed, and plural inverter circuits for supplying high-frequency currents to the plural induction heating coils, respectively, are adapted to be cooled by cooling air flows from cooling portions, and placed in a longitudinal row along the cooling air flows, in air-flow blowing path spaces through which cooling air flows from the cooling portions are blown, so as to facilitate cooling designing for an induction heating device and to improve the cooling performance of the induction heating device.

10 Claims, 8 Drawing Sheets

(56) References Cited

U.S. PATENT DOCUMENTS

| | | | | |
|---|---|---|---|---|
| 7,473,872 | B2 * | 1/2009 | Takimoto | 219/627 |
| 7,786,414 | B2 * | 8/2010 | Schilling et al. | 219/623 |
| 2008/0142512 | A1 * | 6/2008 | Kim et al. | 219/757 |
| 2008/0185376 | A1 * | 8/2008 | Gagas et al. | 219/623 |

FOREIGN PATENT DOCUMENTS

| | | | |
|---|---|---|---|
| JP | 11-087040 | A | 3/1999 |
| JP | 11-297461 | A | 10/1999 |
| JP | 2004-087305 | A | 3/2004 |
| JP | 2004-171879 | A | 6/2004 |
| JP | 2005-078823 | A | 3/2005 |
| JP | 2007-080841 | A | 3/2007 |
| JP | 2007-087962 | A | 4/2007 |

OTHER PUBLICATIONS

International Preliminary Report on Patentability for International Application No. PCT/JP2010/001852, dated Feb. 2, 2012, 5 pages.
Extended European Search Report for European Application No. 10793746.8, dated Sep. 3, 2012, 5 pages.

* cited by examiner

INDUCTION HEATING DEVICE

This application is a 371 application of PCT/JP2010/001852 having an international filing date of Mar. 16, 2010, which claims priority to JP 2009-158742 filed Jul. 3, 2009, the entire contents of which are incorporated herein by reference.

TECHNICAL FIELD

The present invention relates to induction heating devices having plural heating portions which utilize electromagnetic induction, and more particularly relates to induction heating cookers for inductively heating cooking containers.

BACKGROUND ART

In conventional induction heating cookers, for example, in cases of induction heating cookers having two heating coils as heating portions, there have been provided two inverter circuits for supplying high-frequency currents to the respective heating coils on a single substrate. In such conventional induction heating cookers having a configuration as described above, for example, in an induction heating cooker disclosed in JP-A No. 2007-80841, a configuration for cooling the inverter circuits during their operations is adapted to include heat-dissipation members mounted on respective switching devices in the two inverter circuits provided on the single substrate, and also to cool the respective switching devices through air flows from a cooling fan. This induction heating cooker is configured such that the heat-dissipation members mounted on the respective switching devices are placed to be opposed to each other, and air flows from the cooling fan are blown between the heat-dissipation members placed to be opposed to each other.

CITATION LIST

Patent Literatures

PLT 1: Unexamined Japanese Patent Publication No. 2007-80841

SUMMARY OF THE INVENTION

Technical Problem

In an induction heating cooker having a configuration as described above, as a conventional induction heating device, there are provided two inverter circuits for supplying high-frequency currents to each of two heating coils, and each of the inverter circuits is constituted by two switching devices in positive and negative sides. In this induction heating cooker, a single switching device is selected from the two switching devices in the positive and negative sides which constitute each of the inverter circuits, and each of the selected switching devices is mounted on a common heat dissipation member. Namely, the switching devices which are constituents of the different inverter circuits are mounted on the single heat-dissipation member. Thus, the two switching devices which are supplied with high-frequency currents from the different inverter circuits are mounted on each of two heat-dissipation members, these two heat-dissipation members are juxtaposed to each other such that they face to each other, and air flows from a cooling fan are blown between the heat-dissipation members facing to each other, so that the heat-dissipation members are cooled thereby.

Such conventional induction heating cookers having configurations as described above have had problems as follows.

A first problem is the problem of occurrences of imbalances in air volume. Since the heat-dissipation members are placed to be opposed to each other and air flows are blown therebetween, there is a need for striking a balance in cooling performance between the two heat dissipation members placed to be opposed to each other. Namely, there is a need for equally cooling the opposed heat-dissipation members. Therefore, it is necessary to adjust the air-volume balance in cooling air flows from a cooling fan with respect to the opposed heat-dissipation members, but this adjustment is significantly complicated and is not easy. Generally, there exists an air-volume imbalance at a blowing port of a cooling fan, and even an axial fan blows swirling air flows therefrom, and, therefore, even if the blowing port is placed at the middle between the opposed heat-dissipation members, unequal air flows impinge on the opposite heat-dissipation members.

A second problem is that the cooling performance of the heat-dissipation members is inhibited, since plural switching devices which are constituents of different inverter circuits are provided on a single heat-dissipation member. As described above, plural inverter circuits are provided in association with respective heating coils, and switching devices which are constituents of the different inverter circuits are mounted on a single heat-dissipation member. Therefore, when plural to-be-heated objects (cooking containers, such as pans) are heated by different heating coils, the plural inverter circuits are driven concurrently, so that heat generation (heat losses) from the switching devices in the respective inverter circuits is concentrated on the single heat-dissipation member, and thus the switching devices on this heat-dissipation member affect one another, thereby degrading the cooling performance.

The present invention was made to overcome the problems in such conventional induction heating devices and aims at providing an induction heating device capable of facilitating designing of cooling of inverter circuits having plural heating portions and also capable of improving the performance for cooling the inverter circuits.

Solution to Problem

In order to overcome the problems in conventional induction heating devices to attain the object, an induction heating device in a first aspect according to the present invention includes:

a top plate on which a to-be-heated object is allowed to be placed;

plural induction heating coils for inductively heating the to-be-heated object, the induction heating coils being placed just under the top plate;

plural inverter circuits for supplying high-frequency currents to the plural induction heating coils, respectively;

and a cooling portion for blowing cooling air flows to the plural inverter circuits; wherein the plural inverter circuits are placed in an air-flow blowing path space through which cooling air flows from the cooling portion are blown, in a longitudinal row along cooling air flows.

With the induction heating device having the configuration according to the first aspect, it is possible to eliminate the necessity of striking a balance between cooling air flows toward heat-dissipation portions placed to be opposed to each other, which has induced problems in conventional configurations. This facilitates cooling designing and improves the cooling performance.

According to a second aspect, in the induction heating device according to the present invention, the plural inverter circuits according to the first aspect include a first inverter circuit for supplying a high-frequency current to an induction heating coil with a larger maximum output, and a second inverter circuit for supplying a high-frequency current to an induction heating coil with a smaller maximum output, the first inverter circuit is provided closer to a blowing port in the cooling portion than to the second inverter circuit, the first inverter circuit is placed in the upwind side with respect to the second inverter circuit, and cooling air flows from the cooling portion pass through the second inverter circuit, after passing through the first inverter circuit.

The induction heating device having the in the second aspect is capable of directly utilizing, for cooling the second inverter circuit, cooling air flows after cooling the first inverter circuit. This eliminates wasting cooling air flows, thereby providing significant advantages in terms of size reduction and noise reduction in the cooling fan.

According to a third aspect, in the induction heating device according to the present invention, the plural inverter circuits according to the second aspect are provided with each of switching devices mounted on different cooling fins, and cooling air flows from the cooling portion pass through the cooling fin on which the switching device in the second inverter circuit is mounted, after passing through the cooling fin on which the switching device in the first inverter circuit is mounted.

In the induction heating device having the configuration according to the third aspect, the cooling fin on the first inverter circuit is separated from the cooling fin on the second inverter circuit. This prevents heat generation (heat losses) from the switching device in the first inverter circuit and heat generation (heat losses) from the switching device in the second inverter circuit from directly affecting each other through the same cooling fin. This prevents degradation of the cooling of the switching devices.

According to the fourth aspect, in the induction heating device according to the present invention, the plural inverter circuits placed in a longitudinal row according to the first aspect are each provided with a fin area having a cooling fin on which at least a switching device is mounted, and a mounted-component area provided with a heat-generating mounted component to be directly cooled by cooling air flows, such that the fin area and the mounted-component area are separated from each other, and cooling air flows having passed through the fin area are flowed through the fin area in the next-placed inverter circuit, and cooling air flows having passed through the mounted-component area are flowed through the mounted-component area in the next-placed inverter circuit.

In the induction heating device having the configuration according to the fourth aspect, in each of the inverter circuits, the fin areas and the mounted-component areas are separated from each other, and cooling air flows can be flowed in such a way as to be divided into two systems. This makes it easier to adjust the air-volume balance in cooling air flows such that cooling air flows with a larger air volume are flowed toward the fin areas, while cooling air flows with a smaller air volume are flowed toward the mounted-component areas.

This facilitates designing of cooling of each of the inverter circuits. Further, it is possible to directly utilize air flows having cooled the fin area in a previous inverter circuit, for cooling the fin area in the subsequent inverter circuit. Further, it is possible to directly utilize air flows having cooled the mounted-component area in the previous inverter circuit, for cooling the mounted-component area in the subsequent inverter circuit. This eliminates wasting cooling air flows, thereby providing significant advantages in terms of size reduction and noise reduction in the cooling fan.

According to a fifth aspect, in the induction heating device according to the present invention, the plural inverter circuits according to the first aspect each include a cooling fin on which at least a switching device is mounted, and a rectifier for supplying a power supply to the plural inverter circuits is mounted on the cooling fin in the inverter circuit provided most closely to a blowing port in the cooling portion.

In the induction heating device having the configuration according to the fifth aspect, a cooling fin which generates a larger amount of heat is placed in the inverter circuit closest to the blowing port in the cooling portion, and thus is cooled by cooling air flows having higher cooling ability, thereby improving the reliability of the apparatus. Further, in the induction heating device according to the fifth aspect, the plural inverter circuits employ the common rectifier, which can decrease the circuit components and the wiring patterns, thereby reducing the circuit areas.

According to a sixth aspect, in the induction heating device according to the present invention, the plural inverter circuits according to the first aspect are constituted by a first inverter circuit and a second inverter circuit, the first inverter circuit being placed in the upwind side with respect to the second inverter circuit in a longitudinal row along cooling air flows from the cooling portion, there are provided a power-supply circuit for supplying electric power to the first inverter circuit and the second inverter circuit, and a control circuit for controlling the electric power supplied to the first inverter circuit and the second inverter circuit, and the control circuit is adapted such that a total output value constituted by the output of the first inverter circuit and the output of the second inverter circuit is preliminarily set, and further is adapted to perform control for allocating an output within the total output value, as the output of the first inverter circuit and the output of the second inverter circuit.

The induction heating device having the configuration according to the sixth aspect has higher cooling efficiency and also is capable of output-control with excellent safety and reliability.

According to a seventh aspect, in the induction heating device according to the present invention, a power-supply circuit for supplying electric power to the plural inverter circuits according to the first aspect is juxtaposed to the cooling portion and is placed at a place where the power-supply circuit does not directly undergo cooling air flows from the cooling portion.

With induction heating device having the configuration according to the seventh aspect, it is possible to efficiently utilize the space within the apparatus.

According to an eighth aspect, in the induction heating device according to the present invention, according to the first to seventh aspects, the plural inverter circuits placed in a longitudinal row may be covered with a duct at least at portions thereof, and cooling air flows from the cooling portion may be blown through the duct.

With induction heating device having the configuration according to the eighth aspect, it is possible to efficiently blow cooling air flows from the cooling fan to each of the inverter circuits, thereby dramatically improving the cooling performance.

According to a ninth aspect, in the induction heating device according to the present invention, according to the first to eighth aspects, the plural inverter circuits placed in a longitudinal row are each provided with a fin area having a cooling fin on which at least a switching device is mounted, and a mounted-component area provided with a heat-generating mounted component to be directly cooled by cooling air flows, and there may be provided a partition rib for separating cooling air flows passing through the fin area from cooing air flows passing through the mounted-component area.

With induction heating device having the configuration according to the ninth aspect, it is possible to allocate a larger amount of cooling air flows to the fin areas which generate larger amounts of heat, thereby improving the cooling performance.

According to a tenth aspect, in the induction heating device according to the present invention, according to the first to ninth aspects, the plural inverter circuits placed in a longitudinal row is each provided with a cooling fin on which at least a switching device is mounted, and each of the cooling fins provided in the plural inverter circuits may be shaped to have substantially the same cross-sectional shape orthogonal to cooling air flows from the cooing portion.

With induction heating device having the configuration according to the tenth aspect, it is possible to make air flows constant throughout each of the cooling fins, which reduces pressure losses in the cooling air flows passing through the cooling fins, thus improving the cooling performance.

According to an eleventh aspect, in the induction heating device according to the present invention, the plural inverter circuits according to the first to tenth aspects are constituted by a first inverter circuit and a second inverter circuit, the inverter circuits are each configured to create a high-frequency current using two switching devices in a high-voltage side and a low-voltage side, different cooling fins are mounted on each of the switching devices, and each of the cooling fins is placed in a longitudinal row on a straight line along cooling air flows from the cooling portion, the cooling fin on which the high-voltage-side switching device in the first inverter circuit is mounted is placed at a position closest to a blowing port of the cooling portion, and along the cooling air flows, there are placed, in order, the cooling fin on which the low-voltage-side switching device in the first inverter circuit is mounted, the cooling fin on which the high-voltage-side switching device in the second inverter circuit is mounted, and the cooling fin on which the low-voltage-side switching device in the second inverter circuit is mounted.

In the induction heating device having the configuration according to the eleventh aspect, each of the switching devices is mounted on the individual cooling fin, which makes it easier to design the sizes and the like of the cooling fins, according to the amounts of heat generation from the respective switching devices.

Further, in the induction heating device having the configuration according to the eleventh aspect, since the cooling fins on each of the switching devices is provided independently of each other, it is not necessary to insulate the switching devices from the cooling fins. This eliminates the necessity of inserting insulating members such as insulation sheets, between the switching devices and the cooling fins, which prevents degradation of the heat conductivity therebetween, thereby improving the cooling performance.

According to a twelfth aspect, in the induction heating device according to the present invention, the plural inverter circuits according to the first to eleventh aspects are constituted by a first inverter circuit and a second inverter circuit, the inverter circuits are each configured to create a high-frequency current using two switching devices in a high-voltage side and a low-voltage side, and the high-voltage side switching device in the first inverter circuit and the high-voltage side switching device in the second inverter circuit are mounted on the same cooling fin.

In the induction heating device having the according to the twelfth aspect, the common cooling fin is provided on the switching devices which are at the same electric potential on their fin-mounting surfaces. This can improve the cooling performance and also can realize size reduction.

Advantageous Effects of Invention

With the induction heating device according to the present invention, it is possible to improve the performance for cooling inverter circuits having plural heating portions, while facilitating designing of cooling of the inverter circuits.

DETAILED DESCRIPTION OF THE PREFERRED EMBODIMENTS

Hereinafter, there will be described induction heating cookers as examples of induction heating devices according to embodiments of the present invention with reference to the drawings. The induction heating cooker according to the present invention is not limited to the configurations of the induction heating cookers which will be described in the following embodiments and is intended to include induction heating devices configured based on technical ideas equivalent to those which will be described in the following embodiments and based on technical common practice in the technical field.

Embodiment 1

Figure 1:
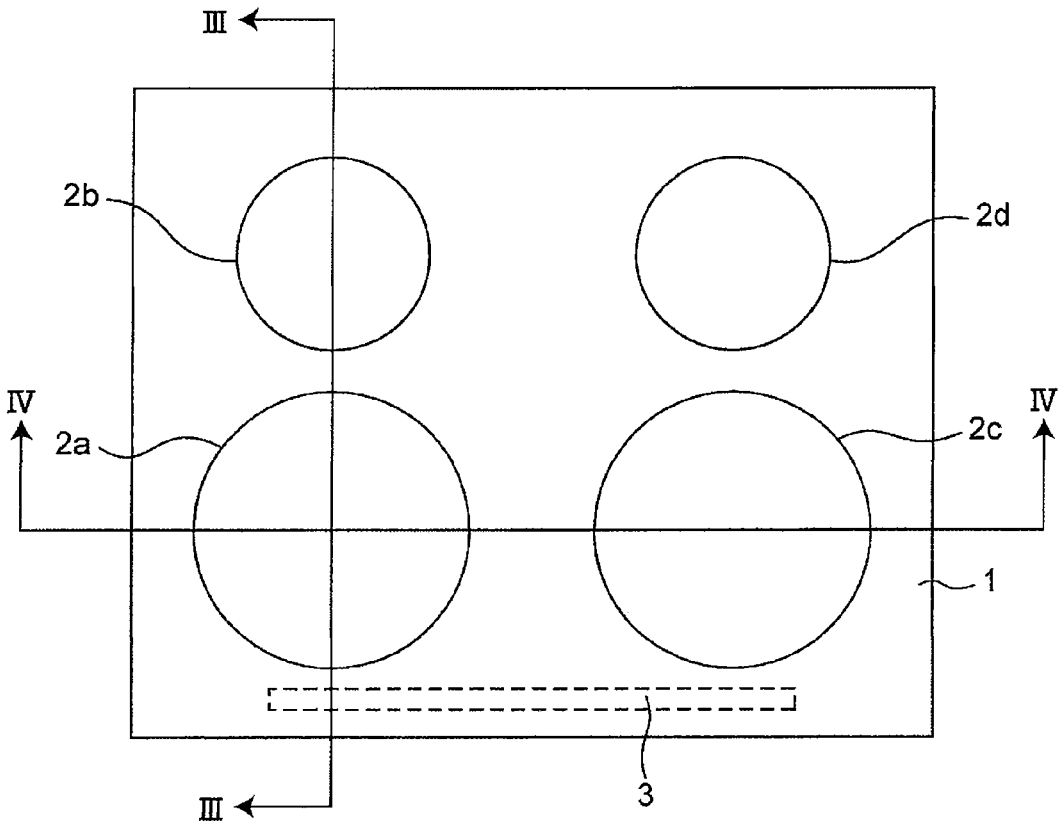
FIG. 1 is a plan view illustrating an external appearance of an induction heating cooker according to an embodiment 1 of the present invention.

FIG. 1 is a plan view illustrating an external appearance of an induction heating cooker according to an embodiment 1 of the present invention to represent a top plate 1 provided at an upper portion of a main body. A lower position in FIG. 1 is the position at which a user is present, and an operation display portion 3 is provided in a front side at which the user is present in the top plate.

The top plate 1 illustrated in FIG. 1 is made of heat-resistant glass, such as crystallized glass. On the top plate 1 there are drawn four circle patterns 2*a*, 2*b*, 2*c* and 2*d* indicating heating positions on which a to-be-heated object (a cooking container, such as a pan) is to be placed. The circle patterns 2*a* and 2*c* having a larger diameter indicate positions corresponding to induction heating coils with a maximum output of 3 kW, for example, and the circle patterns 2*b* and 2*d* having a smaller diameter indicate positions corresponding to induction heating coils with a maximum output of 2 kW, for example.

Figure 2:
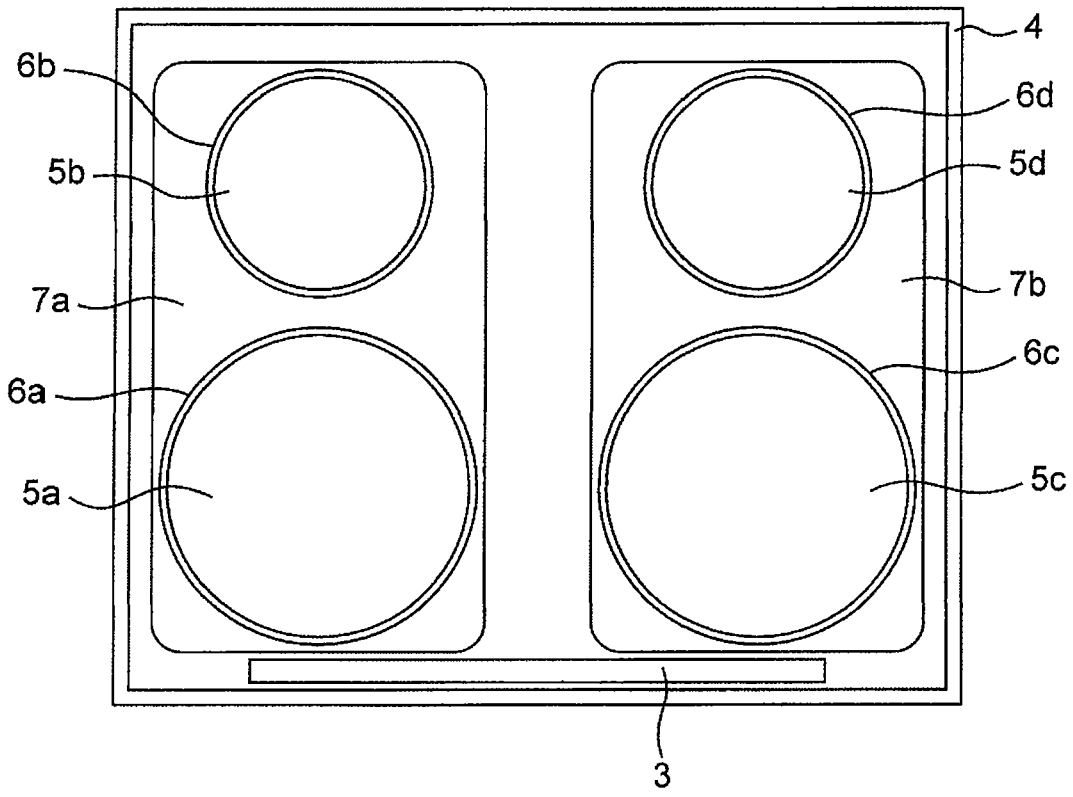
FIG. 2 is a plan view illustrating the induction heating cooker according to the embodiment 1 of the present invention, in a state where a top plate is removed therefrom.

FIG. 2 is a plan view illustrating the main body of the induction heating cooker according to the embodiment 1 in a state where the top plate 1 illustrated in FIG. 1 is removed therefrom.

As illustrated in FIG. 2, the main body is provided with an outer case 4 such that the outer case 4 supports the top plate 1. Just under the circle patterns 2*a*, 2*b*, 2*c* and 2*d* drawn on the top plate 1, there are provided the induction heating coils 5*a*, 5*b*, 5*c* and 5*d*, respectively. The respective induction heating coils 5*a*, 5*b*, 5*c* and 5*d* are secured to heating-coil bases 6*a*, 6*b*, 6*c* and 6*d* made of a material with an insulating property, such as a resin. Further, the heating-coil bases 6*a*, 6*b*, 6*c* and 6 are provided with a ferrite (not illustrated) through which magnetic fluxes generated from the induction heating coils 5*a*, 5*b*, 5*c* and 5*d* pass.

As illustrated in FIG. 1, the heating-coil bases 6*a* and 6*b* to which the induction heating coils 5*a* and 5*b* placed in the left side when viewed from the user are secured are supported by a first supporting plate 7*a* made of an aluminum metal. On the other hand, the heating-coil bases 6*c* and 6*d* to which the induction heating coils 5*c* and 5*d* placed in the right side when viewed from the user are likewise secured are supported by a second supporting plate 7*b* made of an aluminum metal.

Figure 3:
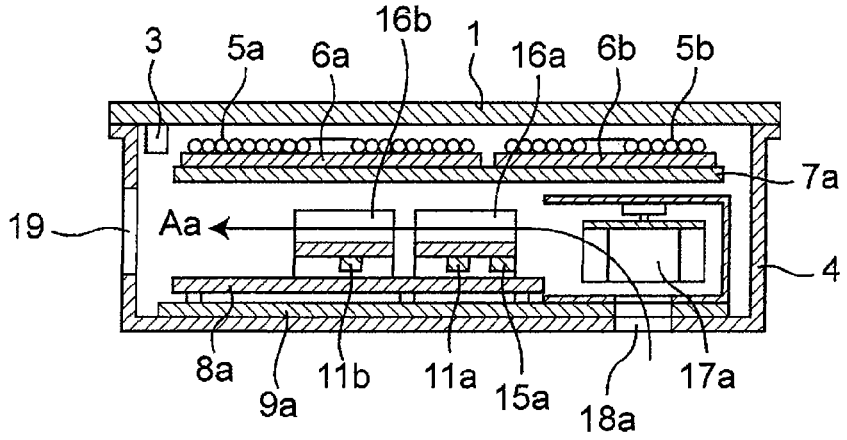
FIG. 3 is a main-part cross-sectional view of the induction heating cooker illustrated in FIG. 1, taken along the line III-III.
Figure 4:
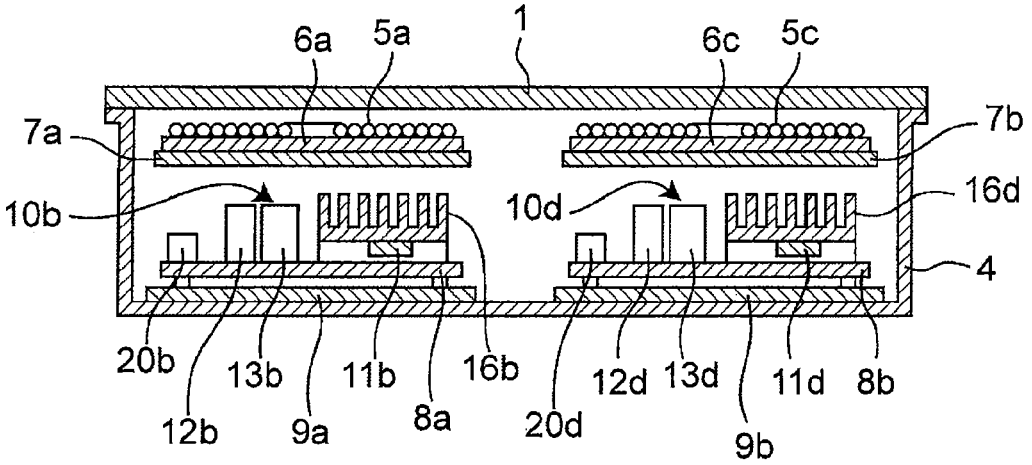
FIG. 4 is a main-part cross-sectional view of the induction heating cooker illustrated in FIG. 1, taken along the line IV-IV.

FIG. 3 is a main-part cross-sectional view of the induction heating cooker illustrated in FIG. 1 taken along the line and FIG. 4 is a main-part cross-sectional view of the induction heating cooker illustrated in FIG. 1 taken along the line IV-IV. In FIG. 3, there are illustrated the induction heating coil 5*a* capable of generating higher outputs (with a maximum output of 3 kW, for example) and the induction heating coil 5*b* capable of generating lower outputs (with a maximum output of 2 kW, for example), and further in a deeper side of the main body of the induction heating cooker, there is illustrated the placement of a cooling blower being a cooling portion as a cooling means. In FIG. 4, there are illustrated the induction heating coils 5*a* and 5*c* capable of generating higher outputs which are laterally juxtaposed to each other.

A first inverter circuit board 8*a* for supplying high-frequency currents to the induction heating coils 5*a* and 5*b* placed in the left side when viewed from the user is disposed under the first supporting plate 7*a* which supports the heating-coil bases 6*a* and 6*b*, and further this first inverter circuit board 8*a* is secured to a first board base 9*a* made of a resin. On the other hand, a second inverter circuit board 8*b* for supplying high-frequency currents to the induction heating coils 5*c* and 5*d* placed in the right side when viewed from the user is disposed under the second supporting plate 7*b* which supports the heating-coil bases 6*c* and 6*d*, and this second inverter circuit board 8*b* is secured to a second board base 9*b* made of a resin. The first board base 9*a* and the second board base 9*b* are secured to the outer case 4.

Figure 5:
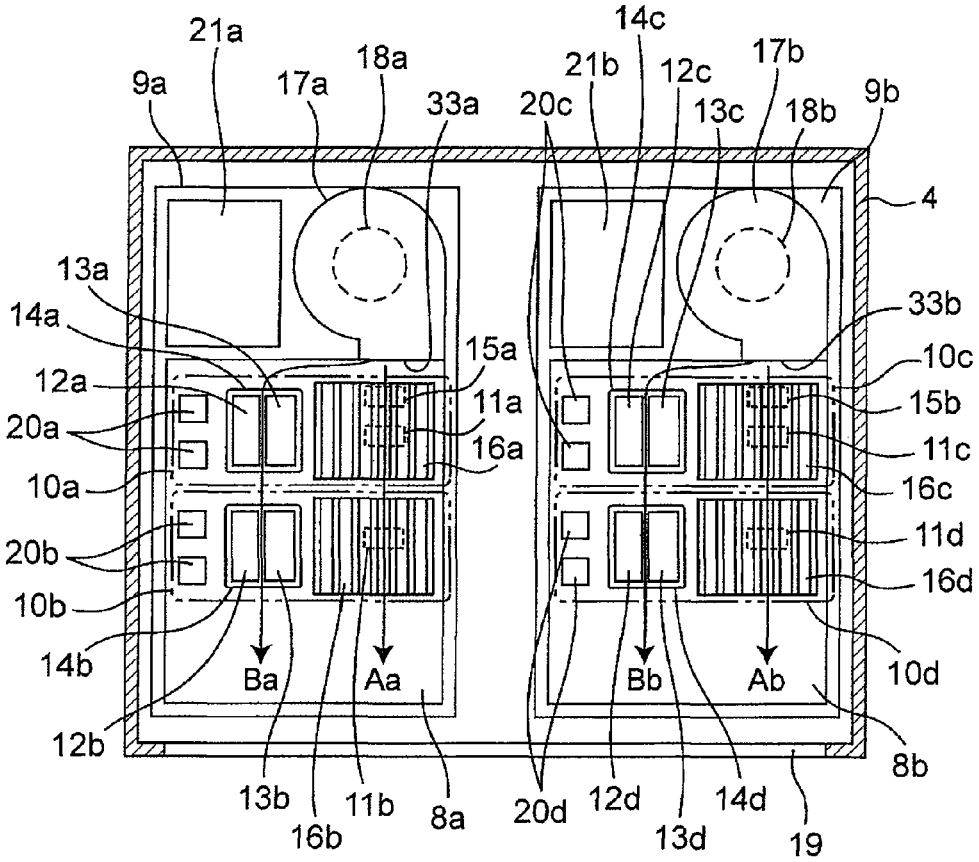
FIG. 5 is a plan view of the induction heating cooker according to the embodiment 1 of the present invention, in a state where the top plate, heating coils and other components have been removed therefrom.
Figure 6:
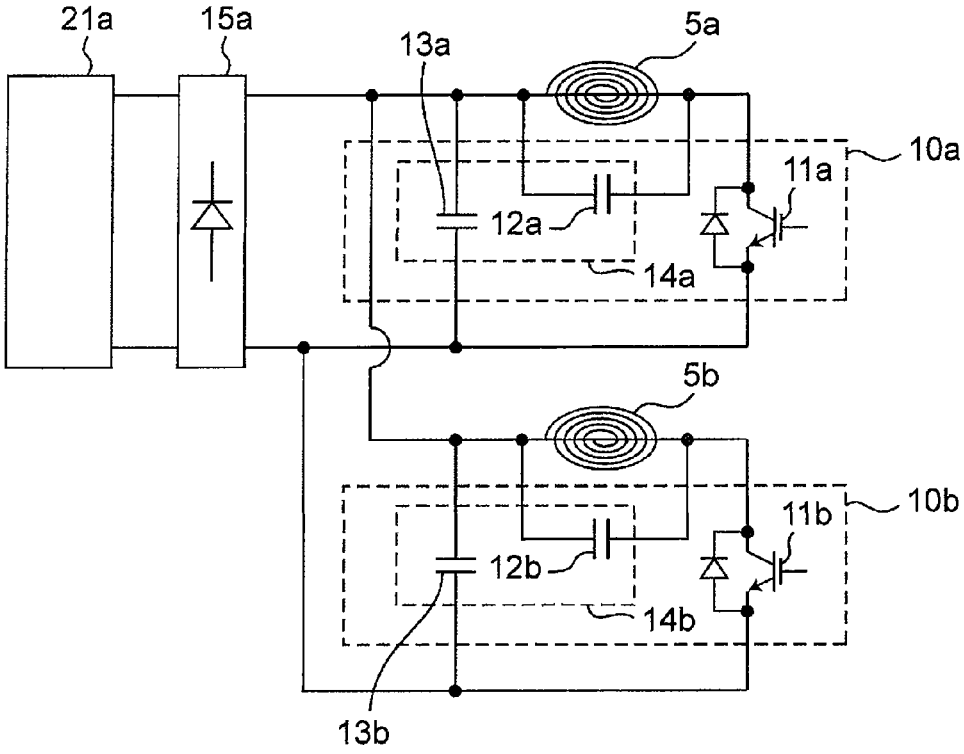
FIG. 6 is a circuit diagram illustrating the configuration of main portions of inverter circuits for supplying high-frequency currents to induction heating coils in the induction heating cooker according to the embodiment 1 of the present invention.

FIG. 5 is a plan view illustrating components relating to a cooling mechanism in the outer case 4 in the induction heating cooker according to the embodiment 1, in which the top plate 1, the induction heating coils 5*a*, 5*b*, 5*c* and 5*d* and other components are removed therefrom. FIG. 6 is a circuit diagram illustrating the configuration of main portions of the inverter circuits for supplying high-frequency currents to the induction heating coils 5*a* and 5*b* in the induction heating cooker according to the embodiment 1. Note that among the components and the configuration relating to the cooling mechanism illustrated in FIG. 5, switching devices, rectifiers and suction ports exist at hidden positions, and therefore their positions are designated by broken lines.

Next, the configuration of the first inverter circuit board 8*a* will be described for supplying high-frequency currents to the induction heating coils 5*a* and 5*b* placed in the left side when viewed from the user, and the like.

Referring to FIG. 5, on the first inverter circuit board 8*a* placed in a left-side area in the outer case 4, there are provided a high-output inverter circuit 10*a* as a first inverter circuit and a low-output inverter circuit 10*b* as a second inverter circuit. The high-output inverter circuit 10*a* as the first inverter circuit includes a switching device 11*a*, and a first passive portion 14*a* constituted by a resonant capacitor 12*a* and a smoothing capacitor 13*a*, etc. On the other hand, the low-output inverter circuit 10*b* as the second inverter circuit includes a switching device 11*b*, and a second passive portion 14*b* constituted by a resonant capacitor 12*b* and a smoothing capacitor 13*b*, etc.

As illustrated in FIG. 6, a power supply provided by a first power-supply circuit board 21*a* is rectified by a rectifier 15*a*, and then is supplied to the high-output inverter circuit 10*a* and the low-output inverter circuit 10*b*. A common first cooling fin 16*a* is mounted on the switching device 11*a* and the rectifier 15*a*, which are indicated by broken lines in FIG. 5, in order to cool heat generated therefrom during operations. Further, the switching device 11*b* illustrated by a broken line in FIG. 5 is mounted on a second cooling fin 16*b* separated from the first cooling fin 16*a*.

As illustrated in FIG. 5, in the induction heating cooker according to the embodiment 1, a first cooling blower 17*a* as a first cooling portion is provided near the first cooling fin 16*a*, and the first cooling fin 16*a* is disposed immediately anterior to a blowing port 33*a* in the first cooling blower 17*a*. Therefore, the first cooling fin 16*a* directly undergoes cooling air flows from the blowing port 33*a* in the first cooling blower 17*a*, and is thereby cooled.

The first cooling blower 17*a* is placed in such a way as to suck external air through a first suction port 18*a* (see FIG. 3 and FIG. 5) formed on a lower surface of the main body and to send cooling air flows directly to the high-output inverter circuit 10*a*. Further, the first cooling blower 17*a* is configured to blow cooling air flows to the high-output inverter circuit 10*a* and also to blow, to the low-output inverter circuit 10*b*, cooling air flows after being blown to the high-output inverter circuit 10*a*. After being blown to the low-output inverter circuit 10*b*, the air flows are discharged to outside of the main body through an exhaust port 19 (see FIG. 3 and FIG. 5) having a larger opening and having a lower ventilation resistance. Accordingly, on the first inverter board 8*a*, the high-output inverter circuit 10*a* is placed at a position, closer to the first suction port 18*a*, where colder external air is sucked compared with the position at which the low-output inverter circuit 10*b* is placed, and air flows after cooling the high-output inverter circuit 10*a* are caused to cool the low-output inverter circuit 10*b*.

In the induction heating cooker according to the embodiment 1, cooling air flows ejected from the blowing port 33*a* in the first cooling blower 17*a* are blown therefrom in such a way as to flow substantially parallel to the direction from the rear surface of the main body (in the upper side in FIG. 5) to the front surface thereof (in the lower side in FIG. 5), thereby forming substantially straight flows within the main body.

As described above, in the induction heating cooker according to the embodiment 1, the first cooling blower 17*a* cools the first inverter circuit board 8*a* on which the high-output inverter circuit 10*a* as the first inverter circuit and the low-output inverter circuit 10*b* as the second inverter circuit are mounted. Therefore, on the first inverter circuit board 8*a*, the first cooling fin 16*a* on which the rectifier 15*a* and the switching device 11*a* of the high-output inverter circuit 10*a* are mounted, and the second cooling fin 16*b* on which the switching device 11*b* of the low-output inverter circuit 10*b* is mounted are placed, in a longitudinal row, along cooling air flows from the first cooling blower 17*a* (in the direction of an arrow Aa in FIG. 5). Namely, the second cooling fin 16*b* on which the switching device 11*b* of the low-output inverter circuit 10*b* is mounted is placed at a position where the second cooling fin 16*b* undergoes cooling air flows having passed through the first cooling fin 16*a* on which the rectifier 15*a* and the switching device 11*a* are mounted.

Note that the first cooling fin 16*a* and the second cooling fin 16*b* which are employed in the induction heating cooker according to the embodiment 1 have the same shape and the same size, and thus have the same cross-sectional shape orthogonal to the direction of cooling air flows. Namely, the first cooling fin 16*a* and the second cooling fin 16*b* include plural fins which are parallel with the direction of cooling air flows, and thus have a so-called comb-form cross-sectional shape orthogonal to the direction of cooling air flows. The first cooling fin 16*a* and the second cooling fin 16*b* are formed by performing extrusion on an aluminum member. Further, in the induction heating cooker according to the embodiment 1, the fins in the first cooling fin 16*a* are placed at positions corresponding to those of the fins in the second cooling fin 16*b*, thereby largely reducing the ventilation resistance therein.

In addition, on the first inverter circuit board 8*a*, the first passive portion 14*a* constituted by the resonant capacitor 12*a* and the smoothing capacitor 13*a* in the high-output inverter circuit 10*a*, and the second passive portion 14*b* constituted by the resonant capacitor 12*b* and the smoothing capacitor 13*b* in the low-output inverter circuit 10*b* are placed in a longitudinal row along cooling air flows from the first blower 17*a* (in the direction of an arrow Ba in FIG. 5). Namely, the second passive portion 14*b* in the low-output inverter circuit 10*b* is placed at a position where the second passive portion 14*b* undergoes cooling air flows having passed through the first passive portion 14*a* in the high-output inverter circuit 10*a*.

As illustrated in FIG. 5, the high-output inverter circuit 10*a* is provided with two heating-coil terminals 20*a*, and the heating-coil terminals 20*a* are electrically connected to the induction heating coil 5*a* (with a maximum output of 3 kW) through lead wires (not illustrated). Similarly, the low-output inverter circuit 10*b* is provided with two heating-coil terminals 20*b*, and the heating-coil terminals 20*b* are electrically connected to the induction heating coil 5*b* (with a maximum output of 2 kW) through lead wires (not illustrated). As described above, the heating-coil terminals 20*a* are electrically connected to the induction heating coil 5*a*, and the heating-coil terminals 20*b* are electrically connected to the induction heating coil 5*b*, so that high-frequency currents created by the inverter circuits 10*a* and 10*b* are, respectively, supplied to the induction heating coils 5*a* and 5*b*.

The first power-supply circuit board 21*a* on which the power-supply circuit for supplying a power supply to the first inverter circuit board 8 is formed is placed near the position at which the first cooling blower 17*a* is provided, and the first power-supply circuit board 21*a* is provided at a position where it does not directly undergo cooling air flows from the blowing port 33*a* in the first cooling blower 17*a*. Namely, the first power-supply circuit board 21*a* is placed at a position in the deeper side in the outer case 4 (in the upper side in FIG. 5), and further is juxtaposed to the first cooling blower 17*a* placed in the deeper side of the outer case 4. Further, the blowing port 33*a* in the first cooling blower 17*a* is placed in such a way as to be oriented toward the first inverter circuit board 8*a* placed in the front side (in the lower side in FIG. 5) in the outer case 4.

Next, there will be described the configuration of the second inverter circuit board 8*b* for supplying high-frequency currents to the induction heating coils 5*c* and 5*d* placed in the right side when viewed from the user, and the like.

Referring to FIG. 5, on the second inverter circuit board 8*b* placed in the right side in the outer case 4, there are provided a high-output inverter circuit 10*c* as a first inverter circuit and a low-output inverter circuit 10*d* as a second inverter circuit. The high-output inverter circuit 10*c* as the first inverter circuit includes a switching device 11*c*, and a third passive portion 14*c* constituted by a resonant capacitor 12*c*, a smoothing capacitor 13*c* and the like. On the other hand, the low-output inverter circuit 10*d* as the second inverter circuit includes a switching device 11*d*, and a fourth passive portion 14*d* constituted by a resonant capacitor 12*d*, a smoothing capacitor 13*d* and the like.

On the second inverter circuit board 8*b*, similarly to on the aforementioned first inverter circuit board 8*a* illustrated in FIG. 6, a power supply provided by a second power-supply circuit board 21*b* is rectified by a rectifier 15*b*, and then is supplied to the high-output inverter circuit 10*c* and the low-output inverter circuit 10*d*. The switching device 11*c* and the rectifier 15*b* indicated by broken lines in FIG. 5 are mounted on a common third cooling fin 16*c*, in order to cool heat generated therefrom during operations. Further, the switching device 11*d* indicated by a broken line in FIG. 5 is mounted on a fourth cooling fin 16*d* which is separated from the third cooling fin 16*c*.

As illustrated in FIG. 5, in the induction heating cooker according to the embodiment 1, there is provided a second cooling blower 17*b* as a second cooling portion as a cooling means, near the third cooling fin 16*c*, and the third cooling fin 16*c* is placed immediately anterior to a blowing port 33*b* in the second cooling blower 17*b*. Therefore, the third cooling fin 16*c* is configured to directly undergo cooling air flows from the blowing port 33*b* in the second cooling blower 17*b*.

The second cooling blower 17*b* is placed in such a way as to suck external air through a second suction port 18*b* (see FIG. 5) formed on the lower surface of the main body and to send cooling air flows directly to the high-output inverter circuit 10*c* on the second inverter circuit board 8*b*. Further, the second cooling blower 17*b* is configured to blow cooling air flows to the high-output inverter circuit 10*c*, and to blow, to the low-output inverter circuit 10*d*, cooling air flows after being blown to the high-output inverter circuit 10*c*. After being blown to the low-output inverter circuit 10*d*, the air flows are discharged to outside of the main body through the exhaust port 19 (see FIG. 5) with a larger opening and with a lower ventilation resistance. Accordingly, on the second inverter board 8*b*, the high-output inverter circuit 10*c* is placed at a position, closer to the second suction port 18*b*, where colder external air is sucked compared with the position at which the low-output inverter circuit 10*d* is placed, and air flows after cooling the high-output inverter circuit 10*c* are caused to cool the low-output inverter circuit 10*d*.

In the induction heating cooker according to the embodiment 1, cooling air flows ejected from the blowing port 33*b* in the second cooling blower 17*b* are blown, thereform, in such a way as to flow substantially parallel to the direction from the rear surface of the main body (in the upper side in FIG. 5) to the front surface thereof (in the lower side in FIG. 5), thereby forming substantially straight flows within the main body.

As described above, in the induction heating cooker according to the embodiment 1, the second cooling blower 17*b* cools the second inverter circuit board 8*b* on which the high-output inverter circuit 10*c* as the first inverter circuit and the low-output inverter circuit 10*d* as the second inverter circuit are mounted. Therefore, on the second inverter circuit board 8*b*, the third cooling fin 16*c* on which the rectifier 15*b* and the switching device 11*c* of the high-output inverter circuit 10*c* are mounted, and the fourth cooling fin 16*d* on which the switching device 11*d* of the low-output inverter circuit 10*d* is mounted are placed in a longitudinal row along cooling air flows from the second cooling blower 17*b* (in the direction of an arrow Ab in FIG. 5). Namely, the fourth cooling fin 16*d* on which the switching device 11*d* of the low-output inverter circuit 10*d* is mounted is placed at a position where the fourth cooling fin 16*d* undergoes cooling air flows having passed through the third cooling fin 16*c* on which the rectifier 15*b* and the switching device 11*c* are mounted.

Note that similarly to the first cooling fin 16*a* and the second cooling fin 16*b* which have been described above, the third cooling fin 16*c* and the fourth cooling fin 16*d* which are employed in the induction heating cooker according to the embodiment 1 have the same shape and the same size, and thus have the same cross-sectional shape orthogonal to the direction of cooling air flows. Namely, similarly to the first cooling fin 16*a* and the second cooling fin 16*b*, the third cooling fin 16*c* and the fourth cooling fin 16*d* include plural fins which are parallel with the direction of cooling air flows and, thus, have a so-called comb-form cross-sectional shape orthogonal to the direction of cooling air flows. The third cooling fin 16*c* and the fourth cooling fin 16*d* are formed by performing extrusion on an aluminum member. Further, in the induction heating cooker according to the embodiment 1, the fins in the third cooling fin 16*c* are placed at positions corresponding to those of the fins in the fourth cooling fin 16*d*, thereby largely reducing the ventilation resistance therein.

In addition, on the second inverter circuit board 8*b*, the third passive portion 14*c* constituted by the resonant capacitor 12*c* and the smoothing capacitor 13*c* in the high-output inverter circuit 10*c*, and the fourth passive portion 14*d* constituted by the resonant capacitor 12*d* and the smoothing capacitor 13*d* in the low-output inverter circuit 10*d* are placed in a longitudinal row along cooling air flows from the second blower 17*b* (in the direction of an arrow Bb in FIG. 5). Namely, the fourth passive portion 14*d* in the low-output inverter circuit 10*d* is placed at a position where the fourth passive portion 14*d* undergoes cooling air flows having passed through the third passive portion 14*c* in the high-output inverter circuit 10*c*.

As illustrated in FIG. 5, the high-output inverter circuit 10*c* is provided with two heating-coil terminals 20*c*, and the heating-coil terminals 20*c* are electrically connected to the induction heating coil 5*c* (with a maximum output of 3 kW) through lead wires (not illustrated). Similarly, the low-output inverter circuit 10*d* is provided with two heating-coil terminals 20*d*, and the heating-coil terminals 20*d* are electrically connected to the induction heating coil 5*d* (with a maximum output of 2 kW) through lead wires (not illustrated). As described above, the heating-coil terminals 20*c* are electrically connected to the induction heating coil 5*c*, and the heating-coil terminals 20*d* are electrically connected to the induction heating coil 5*d*, so that high-frequency currents created by the inverter circuits 10*c* and 10*d* are, respectively, supplied to the induction heating coils 5*c* and 5*d*.

The second power-supply circuit board 21*b*, on which the power-supply circuit for supplying a power supply to the second inverter circuit board 8*b* is formed, is placed near the position at which the second cooling blower 17*b* is provided, and the second power-supply circuit board 21*b* is provided at a position where it does not directly undergo cooling air flows from the blowing port 33*b* in the second cooling blower 17*b*. Namely, the second power-supply circuit board 21*b* is placed at a position in the deeper side in the outer case 4 (in the upper side in FIG. 5) and is juxtaposed to the second cooling blower 17*b* placed in the deeper side of the outer case 4. Further, the blowing port 33*b* in the second cooling blower 17*b* is placed in such a way as to be oriented toward the second inverter circuit board 8*b* placed in the front side (in the lower side in FIG. 5) in the outer case 4.

[Operations of the Induction Heating Cooker]

Next, there will be described operations of the induction heating cooker having the above-described configuration, according to the embodiment 1. In the induction heating cooker according to the embodiment 1, the induction heating coils 5*a* and 5*b* and the first inverter circuit board 8*a* placed in the left side in the outer case 4, and the induction heating coil 5*c* and 5*d* and the second inverter circuit board 8*b* placed in the right side thereof perform substantially the same operations. Therefore, in the following description about operations, operations of the first inverter circuit board 8*a* and the like which are placed in the left side of the induction heating cooker according to the embodiment 1 will be described while operations of the second inverter circuit board 8*b* and the like which are placed in the right side thereof will not be described.

At first, the user places to-be-heated objects which are cooking containers such as pans on circle patterns 2*a* and 2*b* indicating the heating portions on the top plate 1 in the induction heating cooker according to the embodiment 1. Then, the user sets heating conditions and the like through the operation display portion 3. For example, through the operation display portion 3, the user turns on heating switches for the induction heating coils 5*a* and 5*b* corresponding to the circle patterns 2*a* and 2*b*. This activates the high-output inverter circuit 10*a* and the low-output inverter circuit 10*b* on the first inverter circuit board 8*a*, thereby forming desired high-frequency currents. The respective high-frequency currents created by the high-output inverter circuit 10*a* and the low-output inverter circuit 10*b* are supplied, through the heating-coil terminals 20*a* and 20*b*, to the induction heating coils 5*a* and 5*b* corresponding to the circle patterns 2*a* and 2*b*, respectively. This results in the occurrence of high-frequency magnetic fields from the induction heating coils 5*a* and 5*b*, thereby inductively heating the to-be-heated objects such as pans which are placed on the circle patterns 2*a* and 2*b*.

During the induction heating operations as described, the high-frequency current outputted from the heating-coil terminals 20*a* in the high-output inverter circuit 10*a* on the first inverter circuit board 8*a* is created by the switching device 11*a*, the first passive portion 14*a* constituted by the resonant capacitor 12*a* and the smoothing capacitor 13*a*, and the like. Further, the high-frequency current outputted from the heating-coil terminals 20*b* in the low-output inverter circuit 10*b* on the first inverter circuit board 8*a* is created by the switching device 11*b*, the second passive portion 14*b* constituted by the resonant capacitor 12*b* and the smoothing capacitor 13*b*, and the like.

During induction heating operations, heat is generated from the high-frequency-current creating components, such as the switching devices 11*a*, 11*b*, the resonant capacitors 12*a*, 12*b*, the smoothing capacitors 13*a*, 13*b*. In the induction heating cooker according to the embodiment 1, the cooling fins 16*a* and 16*b* are mounted on the switching devices 11*a* and 11*b* which generate particularly larger amounts of heat, to thereby improve the heat-dissipation performance.

In the induction heating cooker according to the embodiment 1, during induction heating operations, the first cooling blower 17*a* is driven to suck external air through the first suction port 18*a*, and further to blow the external air, as cooling air flows, to the high-output inverter circuit 10*a* and the low-output inverter circuit 10*b*, in the mentioned order. The cooling air flows having thus flown are ejected to outside of the main body through the exhaust port 19 which is shaped to have a larger opening and a smaller ventilation resistance. As described above, the induction heating cooker according to the embodiment 1 is adapted to efficiently apply cooling air flows from the first cooling blower 17*a* to the heat-generating components in the respective inverter circuits 10*a* and 10*b*, whereby operations for cooling the heat-generating components are performed with higher efficiency.

Further, as illustrated in FIG. 5, cooling air flows (cooling air flows indicated by the arrow Aa) closer to the blowing port 33*a* in the first cooling blower 17*a* is caused to have an air volume larger than that of cooling air flows (cooling air flows indicated by the arrow Ba) farther from the blowing port 33*a*. Namely, cooling air flows (cooling air flows indicated by the arrow Aa) flowing through an air-flow blowing path space facing to the blowing port 33*a* in the first cooling blower 17*a* have an air volume larger than that of cooling air flows (cooling air flows indicated by the arrow Bb) flowing through an air-flow blowing path space deviated from the blowing port 33*a*. Here the air-flow blowing path space facing to the blowing port is a space facing to the opening plane of the blowing port in the cooling blower, and thus is an air-flow blowing path space whose cross-sectional area orthogonal to the direction of cooling air flows is the same as that of the opening plane of the blowing port.

Accordingly, in the air-flow blowing path space facing to the blowing port 33*a* in the first cooling blower 17*a*, there are provided the first cooling fin 16*a* for cooling the rectifier 15*a* and the switching device 11*a* in the high-output inverter circuit 10*a*, and the second cooling fin 16*b* for cooling the switching device 11*b* in the low-output inverter circuit 10*b*. Further, the first cooling fin 16*a* is placed in the upwind side with respect to the second cooling fin 16*b*, and the first cooling fin 16*a* and the second cooling fin 16*b* are placed in a longitudinal row.

On the other hand, in the air-flow blowing path space deviated from the blowing port 33*a* in the first cooling blower 17*a*, there are provided the first passive portion 14*a* in the high-output inverter circuit 10*a*, and the second passive portion 14*b* in the low-output inverter circuit 10*b*. Further, the first passive portion 14*a* is placed in the upwind side with respect to the second passive portion 14*b*, and the first passive portion 14*a* and the second passive portion 14*b* are placed in a longitudinal row such that they are faced to each other.

As described above, the first cooling fin 16*a* and the second cooling fin 16*b*, which dissipate larger amounts of heat, are placed in the air-flow blowing path space facing to the blowing port 33*a* in the first cooling blower 17*a*, so that the first cooling fin 16*a* and the second cooling fin 16*b* are adapted to be cooled by cooling air flows (cooling air flows indicated by the arrow Aa in FIG. 5) having a larger air volume. On the other hand, the first passive portion 14*a* and the second passive portion 14*b*, which dissipate relatively smaller amounts of heat, are placed in the air-flow blowing path space deviated from the blowing port 33*a* in the first cooling blower 17*a*, so that they are adapted to be cooled by cooling air flows (cooling air flows indicated by the arrow Bb in FIG. 5) having a smaller air volume. The induction heating cooker having the aforementioned configuration according to the embodiment 1 is capable of cooling the first inverter circuit board 8*a* which is placed in consideration of the amount of heat generation therefrom, with higher efficiency, with the single cooling blower 17*a*.

As described above, with the configuration of the induction heating cooker according to the embodiment 1, it is possible to easily adjust the cooling ability, by changing the positional relationship between the blowing port 33*a* in the first cooling blower 17*a* and the to-be-cooled components (for example, the first cooling fin 16*a*, the second cooling fin 16*b*, the first passive portion 14*a*, and the second passive portion 14*b*).

As described above, the first cooling blower 17*a* operates to cool the cooling fins 16*a*, 16*b*, the passive portions 14*a* and 14*b* and the like which are provided on the first inverter circuit board 8*a*. Further, the second cooling blower 17*b* placed in the right side of the outer case 4 is also caused to perform the same cooling operations on the cooling fins 16*c*, 16*d*, the passive portions 14*c* and 14*d* and the like which are provided on the second inverter circuit board 8*b*.

With the configuration of the induction heating cooker according to the embodiment 1, it is possible to cool the high-output inverter circuits 10*a* and 10*b* and, further, it is possible to directly utilize, for cooling the low-output inverter circuits 10*b* and 10*d*, the cooling air flows having cooled the high-output inverter circuits 10*a* and 10*c*. Accordingly, the induction heating cooker according to the embodiment 1 has a configuration capable of utilizing the cooling air flows from the cooling blowers 17*a* and 17*b* with higher efficiency without wasting them, thereby providing significant advantages in terms of size reduction and noise reduction in the cooling blowers 17*a* and 17*b*.

Further, with the configuration of the induction heating cooker according to the embodiment 1, the cooling fins 16*a* and 16*c* on the high-output inverter circuits 10*a* and 10*c* and the cooling fins 16*b* and 16*d* on the low-output inverter circuits 10*b* and 10*d* are separated from each other and are constituted by separated members. This prevents heat generation (heat losses) from the switching devices 11*a* and 11*c* in the high-output inverter circuits 10*a* and 10*b* and heat generation (heat losses) from the switching devices 11*b* and 11*d* in the low-output inverter circuits 10*b* and 10*d* from directly affecting each other through heat conduction through the cooling fins. This ensures that the switching devices 11*a*, 11*b*, 11*c* and 11*d* are cooled by the cooling fins 16*a*, 16*b*, 16*c* and 16*d*, respectively.

As described above, in the induction heating cooker according to the embodiment 1, the cooling fins 16*a*, 16*b*, 16*c* and 16*d* are separated from each other, which eliminates the necessity of taking account of the states of insulation for the switching devices 11*a*, 11*b*, 11*c* and 11*d* which are mounted on the cooling fins 16*a*, 16*b*, 16*c* and 16*d*, respectively. Namely, in the induction heating cooker according to the embodiment 1, there is no need for inserting insulating members between the switching devices 11*a*, 11*b*, 11*c* and 11*d* and the respective cooling fins 16*a*, 16*b*, 16*c* and 16*d* for electrically insulating them from each other. Therefore, with the configuration of the induction heating cooker according to the embodiment 1, it is possible to eliminate the necessity of providing insulating members for degrading heat conductivity, such as insulation sheets, between the switching devices 11*a*, 11*b*, 11*c* and 11*d* and the cooling fins 16*a*, 16*b*, 16*c* and 16*d*, thus resulting in a significant improvement in cooling performance.

In general a switching device is adapted such that its surface on which a cooling fin is to be mounted is at the same electric potential as that of its collector. If a cooling fin is directly mounted on such a switching device, the cooing fin is at the same electric potential as that of the collector of the switching device. As a matter of course, among various types of switching devices, there are some types of switching devices which are provided with insulating members inside their cooling-fin mounted surfaces (the heat-dissipation surfaces), in order to preliminarily insulate these cooling-fin-mounted surfaces (the heat-dissipation surfaces) from the collectors. However, such insulation-type switching devices degrade the heat-conduction performance due to the influence of the insulating members provided inside the heat-dissipation surfaces of the switching devices, thereby inducing the problem of poor heat-conduction performance, similar to the problem induced in cases of mounting the aforementioned insulation sheets.

Therefore, the induction heating cooker according to the embodiment 1 is configured, by employing switching devices each having a cooling-fin-mounted surface (heat-dissipation surface) adapted to be at the collector electric potential, thereby preventing degradation of the cooling performance due to the switching devices themselves, rather than employing insulation-type switching devices.

Further, in the induction heating cooker according to the embodiment 1, the first cooling fin 16*a* and the second cooling fin 16*b* have the same cross-sectional shape orthogonal to substantially-straight cooling air flows from the first cooling blower 17*a*, and the first cooling fin 16*a* and the second cooling fin 16*b* each include plural protruded fins which are placed in parallel with the cooling air flows. Further, along the substantially-straight cooling air flows from the first cooling blower 17*a*, the second cooling fin 16*b* is placed at a position in the downwind side with respect to the first cooling fin 16*a*, in a longitudinal row. This results in reduction of pressure losses in cooling air flows having passed through the first cooling fin 16*a* and the second cooling fin 16*b*, thereby improving the cooling performance. The third cooling fin 16*c* and the fourth cooling fin 16*d* are formed and placed with respect to the second cooling blower 17*b* in the same manner as that of the aforementioned configuration, thereby providing the same effects.

Further, in the induction heating cooker according to the embodiment 1, the cooling fins 16*a*, 16*b*, 16*c* and 16*d* have the same cross-sectional shape, and also have a shape which can be formed by drawing processing. This allows utilization of a common molding die or the like therefor, thereby enabling improvement in productivity and reduction in fabrication cost.

Further, in the induction heating cooker according to the embodiment 1, the high-output inverter circuit 10*a* (or 10*c*) and the low-output inverter circuit 10*b* (or 10*d*) for supplying high-frequency currents to the two induction heating coils 5*a* and 5*b* (or 5*c* and 5*d*) are placed on the single inverter circuit board 8*a* (or 8*b*), which provides the advantage of reduction in the amount of wiring between the circuits, thereby enabling reduction in the size of the inverter circuit board 8*a* (or 8*b*).

In the induction heating cooker according to the embodiment 1, the high-output inverter circuits 10*a* and 10*c* are placed near the cooling blowers 17*a* and 17*b*, and are placed in the upwind side with respect to the low-output inverter circuits 10*b* and 10*d*. Therefore, cooling air flows at a lower temperature and with a high velocity immediately after being sucked through the suction ports 18*a* and 18*b* are blown to the high-output inverter circuits 10*a* and 10*b*. Accordingly, the cooling performance for the high-output inverter circuits 10*a* and 10*c* is set to be higher than the cooling performance for the low-output inverter circuits 10*b* and 10*d*. Thus, it is possible to efficiently cool, with such appropriate cooling performance, the high-output inverter circuits 10*a* and 10*c* for supplying high-frequency currents to the induction heating coils 5*a* and 5*c* having a maximum output of 3 kW, and the low-output inverter circuits 10*b* and 10*d* for supplying high-frequency currents to the induction heating coils 5*b* and 5*d* having a maximum output of 2 kW, for example.

With the induction heating cooker according to the embodiment 1, the user can use it more easily at its front side, and therefore, as illustrated in FIG. 2, the induction heating coils 5*a* and 5*c* with a maximum output of 3 kW, for example, are placed in a front-side area, namely an area closer to the operation display portion 3, while the induction heating coils 5*b* and 5*d* with a maximum output of 2 kW, for example, are placed in a deeper-side area, which can improve the usability for the user. As illustrated in FIG. 5, on each of the inverter circuit boards 8*a* and 8*b* in the outer case 4, the low-output inverter circuits 10*b* and 10*d* are placed in a front-side area, while the high-output inverter circuits 10*a* and 10*c* are placed in a deeper-side area. Thus, the placements of the high-output inverter circuits 10*a* and 10*c* and the low-output inverter circuits 10*b* and 10*d* are opposite from the placement of the induction heating coils 5*a*, 5*b*, 5*c* and 5*d*. However, with the configuration of the induction heating cooker according to the embodiment 1, it is possible to easily change the placement of the outputs of the inverter circuit boards 8*a* and 8*b* and the placement of the outputs of the induction heating coils 5*a*, 5*b*, 5*c* and 5*d*, which facilitates electric connections therebetween.

Further, in the induction heating cooker according to the embodiment 1, the common rectifiers 15*a* and 15*b* are shared for supplying DC-power supplies to the high-output inverter circuits 10*a* and 10*c* and the low-output inverter circuits 10*b* and 10*d*, and these rectifiers 15*a* and 15*b* and the switching devices 11*a* and 11*c* in the high-output inverter circuits 10*a* and 10*c* are mounted on the cooling fins 16*a* and 16*c*, respectively. Accordingly, the single rectifier 15*a* (or 15*b*) is configured to be shared for supplying a power supply to the high-output inverter circuit 10*a* (or 10*c*) and the low-output inverter circuit 10*b* (or 10*d*), which can decrease the components and the wiring patterns on the respective inverter circuit boards 8*a* and 8*b*, thereby largely reducing the circuit areas.

Further, in the induction heating cooker according to the embodiment 1, the rectifier 15*a* provided on the first inverter circuit board 8*a* is mounted, together with the switching device 11*a*, on the first cooling fin 16*a*, and is thereby cooled. The first cooling fin 16*a* is provided immediately anterior to the blowing port 33*a* in the first cooling blower 17*a* and is at a position closer to the first cooling blower 17*a* than to the second cooling fin 16*b*, so that the first cooling fin 16*a* has high cooling performance. Therefore, even though the switching device 11*a* and the rectifier 15*a* are both mounted on the first cooling fin 16*a*, the first cooling fin 16*a* is capable of coping therewith even though it has the same size as that of the second cooling fin 16*b*. Also, even if an attempt is made to improve the cooling performance of the first cooling fin 16*a*, there is no need for forming the first cooling fin 16*a* so as to have a size significantly larger than that of the second cooling fin 16*b*. As a result thereof, it is possible to reduce the area occupied by the first inverter circuit board 8*a* within the internal space in the outer case 4. Further, since the rectifier 15*a* is mounted on the first cooling fin 16*a*, the rectifier 15*a* can be surely cooled, so that it can exert its rectification function with higher reliability. The same applies to the rectifier 15*b* provided on the second inverter circuit board 8*b*.

Further, in the induction heating cooker according to the embodiment 1, the first power-supply circuit board 21*a* supplies electric power to the rectifier 15*a*, and the rectifier 15*a* and the first power-supply circuit board 21*a* are placed at positions close to each other. The rectifier 15*a* is placed at a position closest to the blowing port 33*a* in the first cooling blower 17*a*, on the first inverter circuit board 8*a* near the first cooling blower 17*a* placed in the deeper side in the outer case 4. Further, the first power-supply circuit board 21*a* is juxtaposed to the first cooling blower 17*a*, in the deeper side in the outer case 4. Therefore, with the configuration of the induction heating cooker according to the embodiment 1, it is possible to reduce the length of the AC-power-supply wiring which connects the first power-supply circuit board 21*a* to the rectifier 15*a* on the first inverter circuit board 8*a*. Further, for the rectifier 15*b* provided on the second inverter circuit board 8*b*, similarly, it is possible to reduce the length of the AC-power-supply wiring which connects the second power-supply circuit board 21*b* to the rectifier 15*b* on the second inverter circuit board 8*b*.

Further, in the induction heating cooker according to the embodiment 1, the first power-supply circuit board 21*a* is placed adjacent to the first cooling blower 17*a*, and thus is placed at a position where the first power-supply circuit board 21*a* does not directly undergo cooling air flows from the first cooling blower 17*a*. Thus, with the configuration of the induction heating cooker according to the embodiment 1, the first power-supply circuit board 21*a*, which includes a smaller number of heat-generating components, and therefore is not required to be actively cooled, is placed adjacent to the first cooling blower 17*a* in an area where it does not undergo cooling air flows therefrom. Similarly, the second power-supply circuit board 21*b* can be also placed adjacent to the second cooling blower 17*b* in an area where it does not undergo cooling air flows therefrom. This enables effective utilization of the space within the outer case 4. As a result thereof, with the configuration of the induction heating cooker according to the embodiment 1, it is possible to attain reduction in size and in thickness of the main body, and further it is possible to configure the wiring from the power-supply circuit boards 21*a* and 21*b* to the respective inverter circuit boards 8*a* and 8*b* with higher efficiency and in a preferable sequence.

Namely, by providing a portion for deriving a power-supply cord (not illustrated) for introducing an external power supply thereinto, on the surface of the main body at its rear-surface side (in the deeper side when viewed from the user), it is possible to realize a configuration which facilitates the electric connection between the power-supply cord and the power-supply circuit boards 21*a* and 21*b*. Further, it is possible to easily supply electric power from the power-supply circuit boards 21*a* and 21*b* to the inverter circuit boards 8*a* and 8*b*, the cooling blowers 17*a* and 17*b*, and the like. The electric connections between the induction heating coils 5*a*, 5*b*, 5*c* and 5*d* and the heating-coil terminals 20*a*, 20*b*, 20*c* and 20*d* on the respective inverter circuit boards 8*a* and 8*b*, and the electric connections between the inverter circuit boards 8*a* and 8*b* and the operation display portion 3 are such that the wiring lengths therefor are small, since each of the components is organizationally placed close to one another. This facilitates works and fabrication therefor, thereby largely reducing the fabrication cost.

Further, in the induction heating cooker according to the embodiment 1, there are provided the common power-supply circuit boards 21*a* and 21*b* as power-supply circuits for the high-output inverter circuits 10*a* and 10*b* and the low-output inverter circuits 10*b* and 10*d*. Therefore, it is possible to preliminarily set a maximum value (3 kw, for example) of the total output constituted by the output of the high-output inverter circuit 10*a*, 10*c* (with a maximum output of 3 kW) and the output of the low-output inverter circuit 10*b*, 10*d* (with a maximum output of 2 kW) and, further, to allocate, at a desired ratio, the total output as the respective outputs of the high-output inverter circuit 10*a*, 10*c* and the low-output inverter circuits 10*b*, 10*d*. For example, if the user desires to increase the output of the high-output inverter circuit 10*a*, the output of the low-output inverter circuit 10*b* can be set to be smaller. Such settings and control are performed by a control circuit serving as a control portion provided on the power-supply circuit board.

Settings as described above makes it possible to reduce the amount of heat generation with the total output of the high-output inverter circuit 10*a* and the low-output inverter circuit 10*b*. As a result thereof, it is possible to reduce the cooling performance of the induction heating cooker according to the embodiment 1. For example, it is possible to reduce the performance of the first cooling blower 17*a* to reduce the size thereof, or it is possible to reduce the size of the cooling fins on the first inverter circuit board 8*a*.

Further, in the first cooling blower 17*a* and the second cooling blower 17*b* which are employed in the induction heating cooker according to the embodiment 1, plural blades are placed substantially radially along a peripheral surface of a cylinder and, in this cylindrical shape, there is provided the suction port 18*a*, 18*b* at its one end-face portion on a rotational center shaft. The first cooling blower 17*a* and the second cooling blower 17*b* having the aforementioned configuration are adapted such that, when the cylinder is rotated to move the blades along the peripheral surface, air flows along the inner peripheral surface of the cylindrical case which covers the blades, and the air is ejected therefrom through the blowing port 33*a*, 33*b*. Accordingly, cooling air flows from the first cooling blower 17*a* and the second cooling blower 17*b* are such that cooling air flows with substantially-uniform air volumes are blown from the blowing port 33*a*, 33*b*. However, depending on the specifications of the cooling blowers, in some cases, there may be somewhat larger air volumes, near the outer-periphery side thereof with respect to the blowing ports (in the right side with respect to the blowing ports 33*a* and 33*b* in FIG. 5). In such cases, it is possible to mount the heat-generating components which are to be cooled, such that their center lines are placed on lines biased toward the outer-periphery side from the center lines of the blowing ports.

Further, while the induction heating cooker according to the embodiment 1 has been described as being configured to employ cooling blowers as described above as a cooling means, it is also possible to employ any cooling means capable of generating cooling air flows, such as axial fans.

As described above, with the induction heating cooker according to the embodiment 1 of the present invention, it is possible to eliminate the necessity of striking a balance in air volume between cooling air flows toward heat-dissipation portions juxtaposed to each other, which has induced problems in the configuration of the aforementioned induction heating cooker. This provides the excellent advantages of facilitation of cooling designing and an improvement of the cooling performance. Namely, in general, cooling fins on which switching devices are mounted generate larger amounts of heat, in comparison with heat-generating mounted components (passive portions) which are directly mounted on boards, such as resonant capacitors and smoothing capacitors. Accordingly, in the high-output and low-output inverter circuits (10*a*, 10*b*, 10*c* and 10*d*), the fin areas and the mounted-component areas are placed, such that they are broadly separated from each other in two systems. This makes it easier to adjust the air-volume balance, in blowing cooling air flows from the cooling blowers (17*a*, 17*b*) to the high-output and low-output inverter circuits (10*a*, 10*b*, 10*c* and 10*d*), such that cooling air flows with a larger air volume are flowed toward the fin areas, while cooling air flows with a smaller air volume are flowed toward the mounted-component areas.

Further, with the induction heating cooker according to the embodiment 1 of the present invention, it is possible to easily design a configuration for cooling the high-output inverter circuits (10*a*, 10*c*) and the low-output inverter circuits (10*b* and 10*d*) with a preferable balance therebetween. Further, it is possible to directly utilize, for cooling the low-output inverter circuits (10*b* and 10*d*), the cooling air flows after cooling the high-output inverter circuits (10*a* and 10*c*), which eliminates wasting of cooling air flows. As a result thereof, it is possible to provide significant advantages in terms of size reduction and noise reduction in the cooling blowers.

In the aforementioned conventional induction heating cooker, plural switching devices which are constituents of different inverter circuits are provided on a single heat-dissipation member and, therefore, if the different inverter circuits are concurrently driven, the same cooling fin dissipates generated heat (lost heat) from the switching devices in each of the inverter circuits, which causes heat from each of the switching devices to affect each other through the cooling fin, thereby significantly degrading the cooling ability.

On the other hand, in the induction heating device according to the embodiment 1 of the present invention, the cooling fins (16*a* and 16*c*) on the high-output inverter circuits (10*a* and 10*c*) and the cooling fins (16*b* and 16*d*) on the low-output inverter circuits (10*b* and 10*d*) are separated from each other, which prevents heat generation (heat losses) from the switching devices (11*a* and 11*c*) in the high-output inverter circuits (10*a* and 10*c*) and heat generation (heat losses) from the switching devices (11*b* and 11*d*) in the low-output inverter circuits (10*b* and 10*d*) from directly affecting each other through the same cooling fins. Thus, the induction heating device according to the embodiment 1 has a configuration having no factor which obstructs the cooling of the switching devices.

Further, in the induction heating device according to the embodiment 1 of the present invention, the switching devices in the high-output inverter circuits (10*a* and 10*c*) and the switching devices (11*b*, 11*d*) in the low-output inverter circuits (10*b* and 10*d*) are at different electric potentials, at their fin-mounted surfaces. This necessitates taking a measure such as insulation for the switching devices if common cooling fins made of a metal are employed therefor. However, since the cooling fins (16*a*, 16*c*) on the high-output inverter circuits (10*a* and 10*c*) and the cooling fins (16*b*, 16*d*) on the low-output inverter circuits (10*b* and 10*d*) are separated from each other, there is no need for taking account of insulation between the switching devices and the cooling fins, which eliminates the necessity of taking a measure, such as inserting insulation members, such as insulation sheets, between the switching devices and the cooling fins. Provision of such insulation members such as insulation sheets between the switching devices and the cooling fins will degrade the heat conduction therebetween, thereby degrading the cooling performance. However, with the induction heating device according to the present invention, since the independent cooling fins are provided on each of the switching devices, it is possible to eliminate the necessity of providing insulation members between the switching devices and the cooling fins, thereby improving the cooling performance.

Embodiment 2

Hereinafter, with reference to FIG. 7 to 10, there will be described an induction heating cooker according to an embodiment 2 as an example of the induction heating cooker according to the present invention. The induction heating cooker according to the embodiment 2 is different from the induction heating cooker according to the aforementioned embodiment 1, in the number of switching devices in inverter circuits for supplying high-frequency currents to induction heating coils. In the induction heating cooker according to the embodiment 2, the switching devices in an inverter circuit for a single induction heating coil are constituted by two switching devices, namely a switching device in a positive-electrode side and a switching device in a negative-electrode side. Accordingly, in the description of the induction heating cooker according to the embodiment 2, components having substantially the same functions and configurations as the components in the induction heating cooker according to the aforementioned embodiment 1 will be designated by the same reference characters and will not be described herein.

The induction heating cooker according to the embodiment 2 has substantially the same external appearance as that of the aforementioned induction heating cooker according to the embodiment 1 described with reference to FIGS. 1 and 2, in which induction heating coils 5*a* and 5*b* are placed in the left side when viewed from a user, and induction heating coils 5*c* and 5*d* are placed in the right side when viewed from the user.

Figure 7:
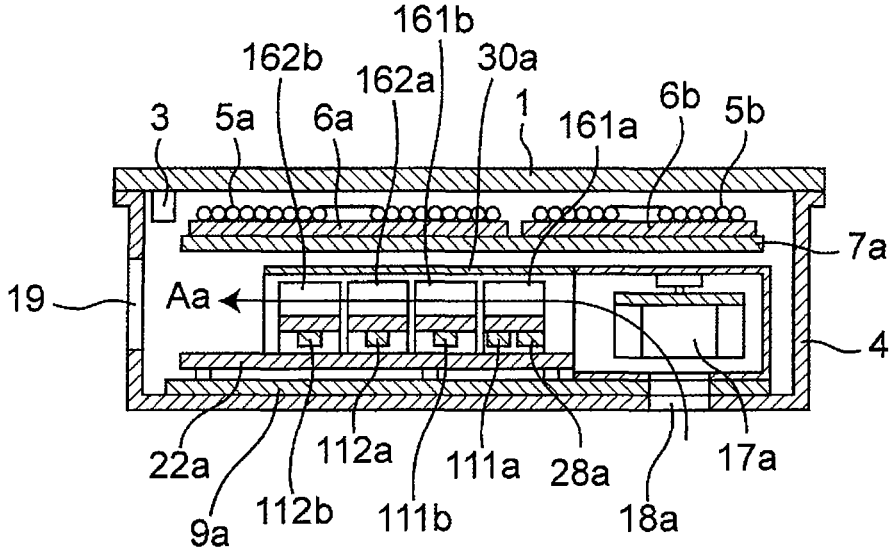
FIG. 7 is a main-part cross-sectional view of an induction heating cooker according to an embodiment 2 of the present invention, taken along a portion including a cooling blower.

Similarly to FIG. 3, FIG. 7 is a cross-sectional view of the induction heating cooker according to the embodiment 2, taken to illustrate main parts in a front side (in a left side in FIG. 7) and a deeper side (in a right side in FIG. 7) thereof. In FIG. 7, there are illustrated the induction heating coil 5*a* capable of generating higher outputs (with a maximum output of 3 kW, for example), and the induction heating coil 5*b* capable of generating lower outputs (with a maximum output of 2 kW, for example), and in a deeper side of the main body of the induction heating cooker according to the embodiment 2, there is illustrated the placement of a cooling blower as a cooling means.

Figure 8:
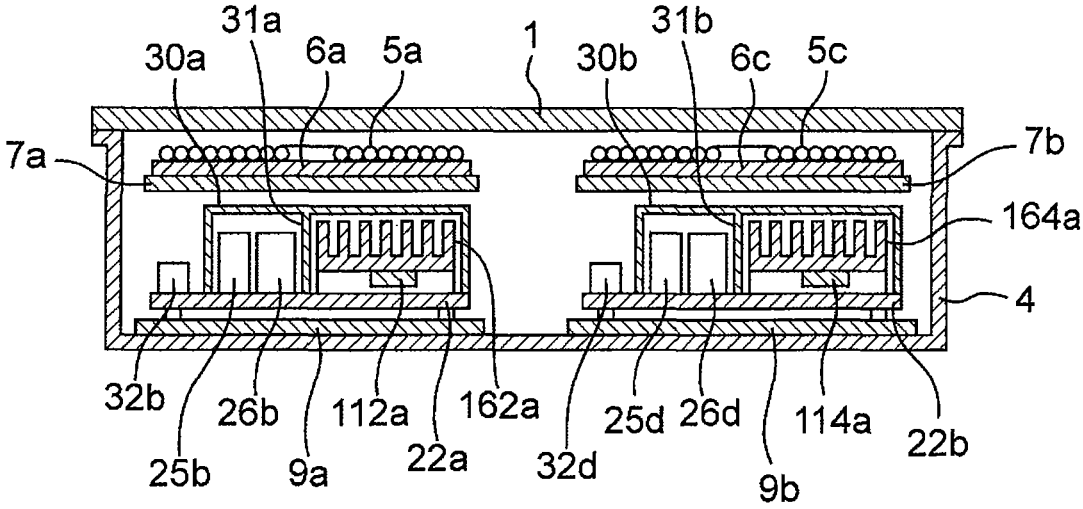
FIG. 8 is a main-part cross-sectional view of the induction heating cooker according to the embodiment 2 of the present invention, taken along a portion which does not include the cooling blower.

FIG. 8 is a cross-sectional view of the induction heating cooker according to the embodiment 2, taken to illustrate main parts in the left side and the right side thereof with respect to the user. In FIG. 8, there are illustrated the high-output induction heating coils 5*a* and 5*c* which are laterally juxtaposed to each other in the induction heating cooker according to the embodiment 2.

Figure 9:
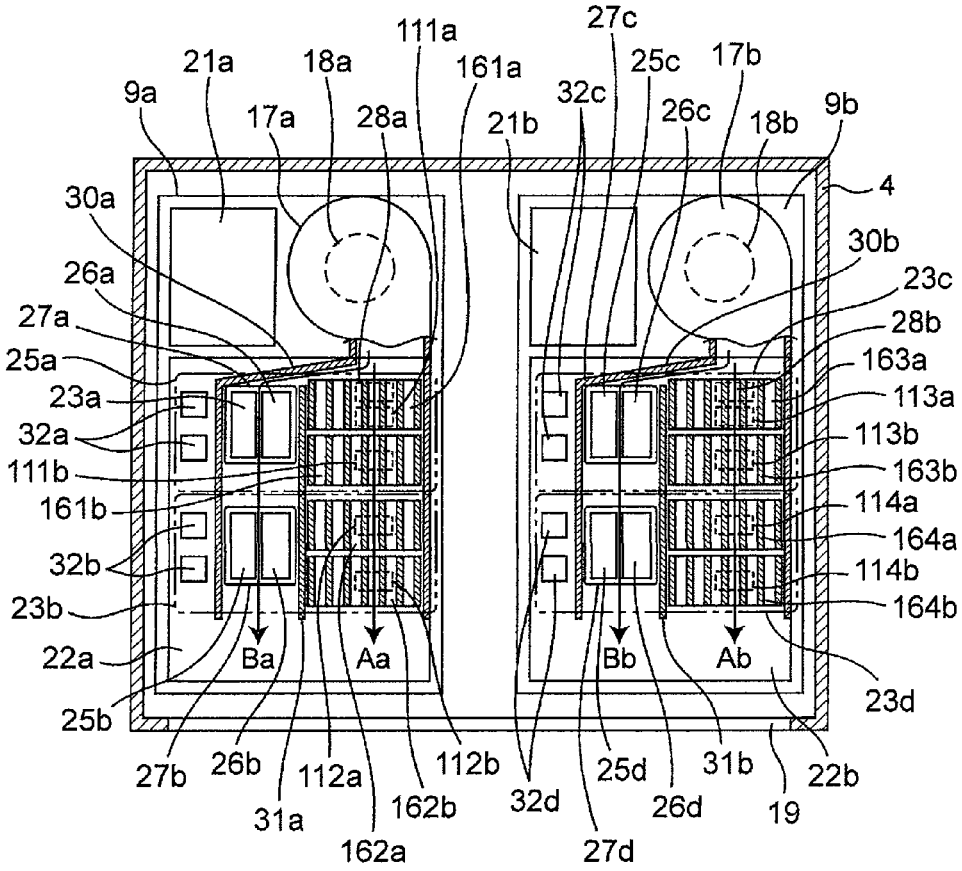
FIG. 9 is a plan view of the induction heating cooker according to the embodiment 2 of the present invention, in a state where the top plate, heating coils and other components have been removed therefrom.
Figure 10:
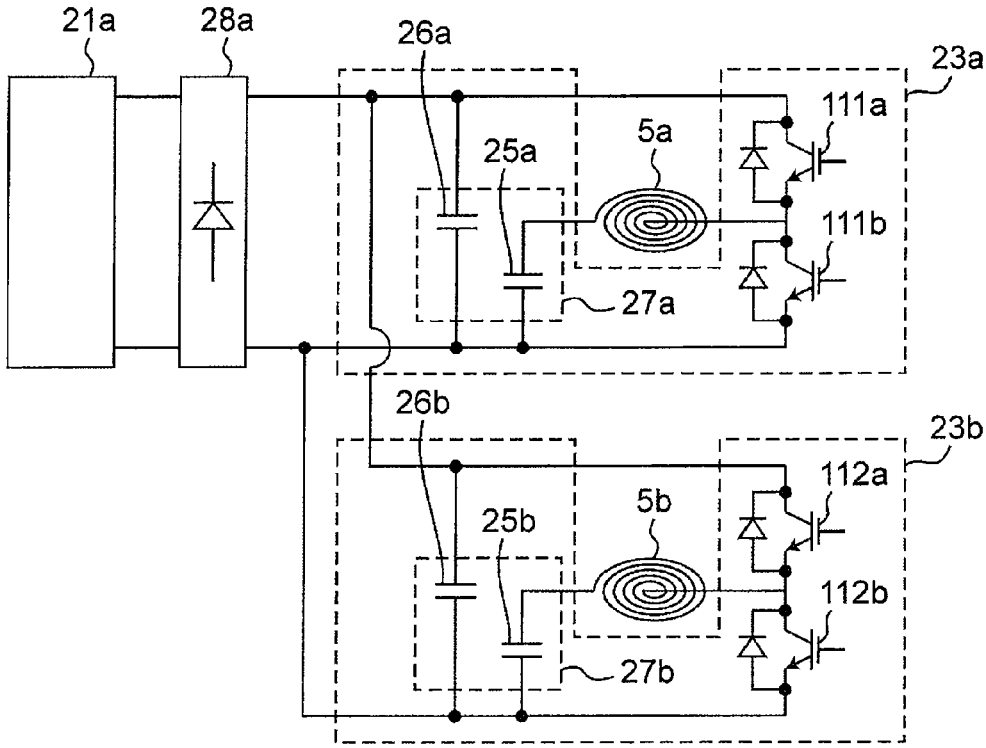
FIG. 10 is a circuit diagram illustrating the configuration of main portions of inverter circuits for supplying high-frequency currents to the induction heating coils in the induction heating cooker according to the embodiment 2 of the present invention.

FIG. 9 is a plan view illustrating components relating to a cooling mechanism in an outer case 4, in the induction heating cooker according to the embodiment 2, where a top plate 1, the induction heating coils 5*a*, 5*b*, 5*c* and 5*d* and other components are removed therefrom. FIG. 10 is a circuit diagram illustrating the configuration of main portions of the inverter circuits for supplying high-frequency currents to the induction heating coils 5*a* and 5*b* in the induction heating cooker according to the embodiment 2. Note that among the components and the configurations relating to the cooling mechanism illustrated in FIG. 9, switching devices (111*a*, 111*b*, 112*a*, 112*b*, 113*a*, 113*b*, 114*a* and 114*b*), rectifiers (28*a* and 28*b*) and suction ports (18*a*, 18*b*) exist at hidden positions, and therefore their positions are designated by broken lines.

In the induction heating cooker according to the embodiment 2, similarly to in the induction heating cooker according to the embodiment 1, a first inverter circuit board 22*a* for supplying high-frequency currents to the induction heating coils 5*a* and 5*b* placed in the left side when viewed from the user is disposed under a first supporting plate 7*a* which supports heating-coil bases 6*a* and 6*b*, and further, this first inverter circuit board 22*a* is secured to a first board base 9*a* made of a resin (see FIG. 8). On the other hand, a second inverter circuit board 22*b* for supplying high-frequency currents to the induction heating coils 5*c* and 5*d* placed in the right side when viewed from the user is disposed under a second supporting plate 7*b* which supports heating-coil bases 6*c* and 6*d*, and further, this second inverter circuit board 22*b* is secured to a second board base 9*b* made of a resin (see FIG. 8). The first board base 9*a* and the second board base 9*b* are secured to the outer case 4.

Hereinafter, there will be described the first inverter circuit board 22*a* for supplying high-frequency currents to the induction heating coils 5*a* and 5*b* placed in the left side when viewed from the user, and a first cooling blower 17*a* for blowing cooling air flows to the first inverter circuit board 22*a*, in terms of the configurations, operations and the like thereof.

Referring to FIG. 9, on the first inverter circuit board 22*a* placed in a left-side area in the outer case 4, there are provided a high-output inverter circuit 23*a* as a first inverter circuit, and a low-output inverter circuit 23*b* as a second inverter circuit. The high-output inverter circuit 23*a* includes two switching devices 111*a* and 111*b*, and a first passive portion 27*a* constituted by a resonant capacitor 25*a* and a smoothing capacitor 26*a*, etc. On the other hand, the low-output inverter circuit 23*b* includes two switching devices 112*a* and 112*b*, and a second passive portion 27*b* constituted by a resonant capacitor 25*b* and a smoothing capacitor 26*b*, etc.

As illustrated in FIG. 10, a power supply provided by a first power-supply circuit board 21*a* is rectified by the rectifier 28*a*, and then is supplied to the high-output inverter circuit 23*a* as the first inverter circuit and the low-output inverter circuit 23*b* as the second inverter circuit. A common first cooling fin 161*a* is mounted on the switching device 111*a* and the rectifier 28*a*, which are indicated by broken lines in FIG. 9, in order to cool heat generated therefrom during operations. Further, the switching devices 111*b*, 112*a* and 112*b* indicated by broken lines in FIG. 9 are mounted on a second cooling fin 161*b*, a third cooling fin 162*a* and a fourth cooling fin 162*b*, respectively, which are separated from the first cooling fin 161*a*.

As illustrated in FIG. 7 to 9, there is provided a duct 30*a* at a blowing port 33*a* in a first cooling blower 17*a* placed in the deeper side in the outer case 4. The duct 30*a* is provided to surround the first inverter circuit board 22*a* from thereabove and covers the components mounted thereon, such as the first cooling fin 161*a*, the second cooling fin 161*b*, the third cooling fin 162*a*, the fourth cooling fin 162*b*, the first passive portion 27*a*, the second passive portion 27*b*. The duct 30*a* is mounted, at one of its opening portions serving as a suction port thereof, to the blowing port 33*a* in the first cooling blower 17*a*. Further, the other opening portion of the duct 30*a* serving as an exhaust port thereof is provided at a position where there is no heat-generating component mounted on the first inverter circuit board 22*a* anymore, for example, immediately posterior to its portion covering the fourth cooling fin 162*b*.

In the induction heating cooker according to the embodiment 2, there is provided the duct 30*a* as described above, and further, there is provided a partition rib 31*a* inside the duct 30*a*. As illustrated in FIG. 9, the partition rib 31*a* separates the fin areas in which there are placed the first cooling fin 161*a*, the second cooling fin 161*b*, the third cooling fin 162*a* and the fourth cooling fin 162*b*, from the mounted-component areas in which there are placed the first passive portion 27*a* and the second passive portion 27*b*. As described above, due to the provision of the duct 30*a* and the partition rib 31*a*, cooling air flows from the blowing port 33*a* in the first cooling blower 17*a* are surely divided into the fin areas and the mounted-component areas.

In the induction heating cooker according to the embodiment 2, in the high-output and low-output inverter circuits 23*a*, 23*b*, 23*c* and 23*d*, the fin areas and the mounted-component areas are separated from each other, along cooling air flows, namely along the direction from the deeper side of the outer case 4 to the front side thereof, so that these respective areas are separated in the left and right sides.

Further, in the description of the induction heating cooker according to the embodiment 2 of the present invention, within the high-output and low-output inverter circuits 23*a*, 23*b*, 23*c* and 23*d*, the areas in which there are placed the cooling fins 161*a*, 161*b*, 162*a*, 162*b*, 163*a*, 163*b*, 164*a* and 164*b* will be referred to as fin areas, while the areas in which there are placed the passive portions including the resonant capacitors and the smoothing capacitors serving as heat-generating mounted components which are mounted on the boards and generate heat during operations, will be referred to as mounted-component areas.

As illustrated in FIG. 9, in the induction heating cooker according to the embodiment 2, the first cooling blower 17*a* is provided near the first cooling fin 161*a*, and the first cooling fin 161*a* is placed immediately anterior to the blowing port 33*a* in the first cooling blower 17*a*. Therefore, the first cooling fin 161*a* is adapted to directly undergo cooling air flows having been divided by the duct 30*a* and the partition rib 31*a* after having been generated from the blowing port 33*a* in the first cooling blower 17*a*.

The first cooling blower 17*a* is placed in such a way as to suck external air through the first suction port 18*a* (see FIG. 7 and FIG. 9) formed on the lower surface of the main body and to discharge cooling air flows from the blowing port 33*a*, such that the cooling air flows divided by the duct 30*a* and the partition rib 31*a* are directly blown to the high-output inverter circuit 23*a* on the first inverter circuit board 22*a*. Further, the first cooling blower 17*a* is adapted such that cooling air flows from the first cooling blower 17*a* which have been divided are blown to the high-output inverter circuit 23*a*, and cooling air flows after being blown to the high-output inverter circuit 23*a* are blown to the low-output inverter circuit 23*b*. After being blown to the low-output inverter circuit 23*b*, the air flows are discharged to outside of the main body through an exhaust port 19 (see FIG. 7 and FIG. 9) having a larger opening and having a lower ventilation resistance.

In the induction heating cooker according to the embodiment 2, cooling air flows having been ejected from the blowing port 33*a* in the first cooling blower 17*a* and further having been divided by the duct 30*a* and the partition rib 31*a* are blown in such a way as to form flows substantially parallel to the direction from the rear surface of the main body to the front surface thereof, thereby forming substantially-straight flows.

In the induction heating cooker according to the embodiment 2, cooling air flows from the first cooling blower 17*a* are divided into the fin areas and the mounted-component areas, through the partition rib 31*a* in the duct 30*a*, such that a major part of the air volume of discharged air flows, for example, 80% of the cooling air flows are flowed to the fin areas (in the direction indicated by an arrow Aa in FIG. 9), thereby cooling the first cooling fin 161*a*, the second cooling fin 161*b*, the third cooling fin 162*a* and the fourth cooling fin 162*b*. Further, cooling air flows having the remaining air volume are flowed to the mounted-component areas (in the direction indicated by an arrow Ba in FIG. 9), thereby cooling the first passive portion 27*a* and the second passive portion 27*b*.

Specifically, the first cooling fin 161*a* and the second cooling fin 161*b* on the high-output inverter circuit 23*a*, and the third cooling fin 162*a* and the fourth cooling fin 162*b* on the low-output inverter circuit 23*b* are placed in a longitudinal row, along cooling air flows from the first cooling blower 17*a* (in the direction indicated by the arrow Aa in FIG. 9). Namely, the second cooling fin 161*b* on which the switching device 111*b* is mounted is placed at a position where the second cooling fin 161*b* undergoes cooling air flows having passed through the first cooling fin 161*a* on which the rectifier 28*a* and the switching device 111*a* are mounted. Similarly, the third cooling fin 162*a* on which the switching device 112*a* is mounted is placed at a position where the third cooling fin 162*a* undergoes cooling air flows having passed through the second cooling fin 161*b*, and the fourth cooling fin 162*b* on which the switching device 112*b* is mounted is placed at a position where the fourth cooling fin 162*b* undergoes cooling air flows having passed through the third cooling fin 162*a*.

Further, on the first inverter circuit board 22*a*, the first passive portion 27*a* constituted by the resonant capacitor 25*a* and the smoothing capacitor 26*a* in the high-output inverter circuit 23*a*, and the second passive portion 27*b* constituted by the resonant capacitor 25*b* and the smoothing capacitor 26*b* in the low-output inverter circuit 23*b* are placed in a longitudinal row along cooling air flows from the first blower 17*a* (in the direction of the arrow Ba in FIG. 9). Namely, the second passive portion 27*b* in the low-output inverter circuit 23*b* is placed at a position where the second passive portion 27*b* undergoes cooling air flows having passed through the first passive portion 27*a* in the high-output inverter circuit 23*a*.

As illustrated in FIG. 9, the high-output inverter circuit 23*a* is provided with two heating-coil terminals 32*a*, and the heating-coil terminals 32*a* are electrically connected to the induction heating coil 5*a* (with a maximum output of 3 kW) through lead wires (not illustrated). Similarly, the low-output inverter circuit 23*b* is provided with two heating-coil terminals 32*b*, and the heating-coil terminals 32*b* are electrically connected to the induction heating coil 5*b* (with a maximum output of 2 kW) through lead wires (not illustrated). As described above, the heating-coil terminals 32*a* are electrically connected to the induction heating coil 5*a*, and the heating-coil terminals 32*b* are electrically connected to the induction heating coil 5*b*, so that high-frequency currents created by the respective inverter circuits 23*a* and 23*b* are supplied to the induction heating coils 5*a* and 5*b*, respectively.

The first power-supply circuit board 21*a*, on which there is formed the power-supply circuit for supplying a power supply to the first inverter circuit board 22*a*, is placed near the position at which the first cooling blower 17*a* is provided, and the first power-supply circuit board 21*a* is provided at a position where the first power-supply circuit board 21*a* does not directly undergo cooling air flows from the first cooling blower 17*a*. Namely, the first power-supply circuit board 21*a* is placed at a position in the deeper side (in the upper side in FIG. 9) in the outer case 4, and is juxtaposed to the first cooling blower 17*a* placed in the deeper side of the outer case 4. Further, the blowing port 33*a* in the first cooling blower 17*a* is placed in such a way as to be oriented toward the first inverter circuit board 22*a* placed in the front side (in the lower side in FIG. 9) in the outer case 4, and there are provided the duct 30*a* and the partition rib 31*a*.

Next, there will be described the configuration of the second inverter circuit board 22*b* for supplying high-frequency currents to the induction heating coils 5*c* and 5*d* placed in the right side when viewed from the user, and the like.

Referring to FIG. 9, on the second inverter circuit board 22*b* placed in the right side in the outer case 4, there are provided the high-output inverter circuit 23*c* as a first inverter circuit and the low-output inverter circuit 23*d* as a second inverter circuit. The high-output inverter circuit 23*c* includes two switching devices 113*a* and 113*b*, and a third passive portion 27*c* constituted by a resonant capacitor 25*c*, a smoothing capacitor 26*c* and the like. On the other hand, the low-output inverter circuit 23*d* includes two switching devices 114*a* and 114*b*, and a fourth passive portion 27*d* constituted by a resonant capacitor 25*d*, a smoothing capacitor 26*d* and the like.

On the second inverter circuit board 22*b*, similarly to on the aforementioned first inverter circuit board 22*a* illustrated in FIG. 10, a power supply provided by a second power-supply circuit board 21*b* is rectified by the rectifier 28*b*, and is supplied to the high-output inverter circuit 23*c* and the low-output inverter circuit 23*d*. The switching device 113*a* and the rectifier 28*b* indicated by broken lines in FIG. 9 are mounted on a common fifth cooling fin 163*a*, in order to cool heat generated therefrom during operations. Further, the switching devices 113*b*, 114*a* and 114*b* indicated by broken lines in FIG. 9 are mounted on a sixth cooling fin 163*b*, a seventh cooling fin 164*a* and an eighth cooling fin 164*b*, respectively, which are separated from the fifth cooling fin 163*a*.

As illustrated in FIGS. 7 to 9, there is provided a duct 30*b* at a blowing port 33*b* in a second cooling blower 17*b* placed in the deeper side in the outer case 4. The duct 30*b* is provided to surround the second inverter circuit board 22*b* from thereabove and covers the components mounted thereon, such as the fifth cooling fin 163*a*, the sixth cooling fin 163*b*, the seventh cooling fin 164*a*, the eighth cooling fin 164*b*, the third passive portion 27*c*, the fourth passive portion 27*d*. The duct 30*b* is mounted, at one of its opening portions serving as a suction port thereof, to the blowing port 33*b* in the second cooling blower 17*b*. Further, the other opening portion of the duct 30*b* serving as an exhaust port thereof is provided at a position where there is no heat-generating component mounted on the second inverter circuit board 22*b* anymore, for example, immediately posterior to its portion covering the eighth cooling fin 164*b*.

In the induction heating cooker according to the embodiment 2, there is provided the duct 30*b* as described above, and further there is provided a partition rib 31*b* inside the duct 30*b*. As illustrated in FIG. 9, the partition rib 31*b* separates the fin areas in which there are placed the fifth cooling fin 163*a*, the sixth cooling fin 163*b*, the seventh cooling fin 164*a* and the eighth cooling fin 164*b*, from the mounted-component areas in which there are placed the third passive portion 27*c* and the fourth passive portion 27*d*. As described above, due to the provision of the duct 30*b* and the partition rib 31*b*, cooling air flows from the blowing port 33*b* in the second cooling blower 17*b* are surely divided into the fin areas and the mounted-component areas.

As illustrated in FIG. 9, in the induction heating cooker according to the embodiment 2, the fifth cooling fin 163*a* is provided near the second cooling blower 17*b*, and is placed immediately anterior to the blowing port 33*b* in the second cooling blower 17*b*. Therefore, the fifth cooling fin 163*a* is adapted to directly undergo cooling air flows having been divided by the duct 30*b* and the partition rib 31*b* after having been generated from the blowing port 33*b* in the second cooling blower 17*b*.

The second cooling blower 17*b* is placed in such a way as to suck external air through the second suction port 18*b* (see FIG. 9) formed on the lower surface of the main body and to discharge cooling air flows from the blowing port 33*b*, such that the cooling air flows divided by the duct 30*b* and the partition rib 31*b* are directly blown to the high-output inverter circuit 23*c* on the second inverter circuit board 22*b*. Further, the second cooling blower 17*b* is adapted such that cooling air flows from the second cooling blower 17*b* which have been divided are blown to the high-output inverter circuit 23*c*, and further cooling air flows after being blown to the high-output inverter circuit 23*c* are blown to the low-output inverter circuit 23*d*. After being blown to the low-output inverter circuit 23*d*, the air flows are discharged to outside of the main body through the exhaust port 19 (see FIG. 9) having a larger opening and having a lower ventilation resistance.

In the induction heating cooker according to the embodiment 2, cooling air flows having been ejected from the blowing port 33*b* in the second cooling blower 17*b* and further having been divided by the duct 30*b* and the partition rib 31*b* are blown in such a way as to form flows substantially parallel to the direction from the rear surface of the main body to the front surface thereof, thereby forming substantially-straight flows.

In the induction heating cooker according to the embodiment 2, cooling air flows from the second cooling blower 17*b* are divided into the fin areas and the mounted-component areas, through the partition rib 31*b* in the duct 30*b*, such that a major part of the air volume of discharged air flows, for example, 80% of the cooling air flows are flowed to the fin areas (in the direction indicated by an arrow Ab in FIG. 9), thereby cooling the fifth cooling fin 163*a*, the sixth cooling fin 163*b*, the seventh cooling fin 164*a* and the eighth cooling fin 164*b*. Further, cooling air flows having the remaining air volume are flowed to the mounted-component areas (in the direction indicated by an arrow Bb in FIG. 9), thereby cooling the third passive portion 27*c* and the fourth passive portion 27*d*.

Specifically, the fifth cooling fin 163*a* and the sixth cooling fin 163*b* on the high-output inverter circuit 23*c*, and the seventh cooling fin 164*a* and the eighth cooling fin 164*b* on the low-output inverter circuit 23*d* are placed in a longitudinal row, along cooling air flows from the second cooling blower 17*b* (in the direction indicated by the arrow Ab in FIG. 9). Namely, the sixth cooling fin 163*b* on which the switching device 113*b* is mounted is placed at a position where the sixth cooling fin 163*b* undergoes cooling air flows having passed through the fifth cooling fin 163*a* on which the rectifier 28*b* and the switching device 113*a* are mounted. Similarly, the seventh cooling fin 164*a* on which the switching device 114*a* is mounted is placed at a position where the seventh cooling fin 164*a* undergoes cooling air flows having passed through the sixth cooling fin 163*b*, and the eighth cooling fin 164*b* on which the switching device 114*b* is mounted is placed at a position where the eighth cooling fin 164*b* undergoes cooling air flows having passed through the seventh cooling fin 164*a*.

Further, on the second inverter circuit board 22*b*, the third passive portion 27*c* constituted by the resonant capacitor 25*c* and the smoothing capacitor 26*c* in the high-output inverter circuit 23*c*, and the fourth passive portion 27*d* constituted by the resonant capacitor 25*c* and the smoothing capacitor 26*c* in the low-output inverter circuit 23*c* are placed in a longitudinal row along cooling air flows from the second cooling blower 17*b* (in the direction of an arrow Bb in FIG. 9). Namely, the fourth passive portion 27*d* in the low-output inverter circuit 23*d* is placed at a position where the fourth passive portion 27*d* undergoes cooling air flows having passed through the third passive portion 27*c* in the high-output inverter circuit 23*c*.

As illustrated in FIG. 9, the high-output inverter circuit 23*c* is provided with two heating-coil terminals 32*c*, and the heating-coil terminals 32*c* are electrically connected to the induction heating coil 5*c* (with a maximum output of 3 kW) through lead wires (not illustrated). Similarly, the low-output inverter circuit 23*d* is provided with two heating-coil terminals 32*d*, and the heating-coil terminals 32*d* are electrically connected to the induction heating coil 5*d* (with a maximum output of 2 kW) through lead wires (not illustrated). As described above, the heating-coil terminals 32*c* are electrically connected to the induction heating coil 5*c*, and the heating-coil terminals 32*d* are electrically connected to the induction heating coil 5*d*, so that high-frequency currents created by the respective inverter circuits 23*c* and 23*d* are supplied to the induction heating coils 5*c* and 5*d*, respectively.

The second power-supply circuit board 21*b*, on which there is formed the power-supply circuit for supplying a power supply to the second inverter circuit board 22*b*, is placed near the position at which the second cooling blower 17*b* is provided, and the second power-supply circuit board 21*b* is provided at a position where it does not directly undergo cooling air flows from the second cooling blower 17*b*. Namely, the second power-supply circuit board 21*b* is placed at a position in the deeper side (in the upper side in FIG. 9) in the outer case 4, and is juxtaposed to the second cooling blower 17*b* placed in the deeper side of the outer case 4. Further, the blowing port 33*b* in the second cooling blower 17*b* is placed in such a way as to be oriented toward the first inverter circuit board 22*a* placed in the front side (in the lower side in FIG. 9) in the outer case 4. Further, there are provided the duct 30*b* and the partition rib 31*b*.

Note that each of the cooling fins 161*a* to 164*b* which is employed in the induction heating cooker according to the embodiment 2 have the same shape and the same size, and thus have the same cross-sectional shape orthogonal to the direction of cooling air flows. Namely, each of the cooling fins 161*a* to 164*b* includes plural fins which are parallel with the direction of cooling air flows, and thus has a so-called comb-form cross-sectional shape orthogonal to the direction of cooling air flows. The respective cooling fins 161*a* to 164*b* are formed by performing extrusion on an aluminum member. Further, in the induction heating cooker according to the embodiment 2, the respective fins in the first to fourth cooling fins 161*a* to 162*b* are placed at positions corresponding to each other, and similarly the respective fins in the fifth to eighth cooling fins 163*a* to 164*b* are placed at positions corresponding to each other. This largely reduces the ventilation resistance in the respective cooling fins 161*a* to 164*b* in the fin areas, in the induction heating cooker according to the embodiment 2.

[Operations of the Induction Heating Cooker]

Next, there will be described operations of the induction heating cooker having the aforementioned configuration, according to the embodiment 2. In the induction heating cooker according to the embodiment 2, the induction heating coils 5*a* and 5*b* and the first inverter circuit board 22*a* placed in the left side in the outer case 4, and the induction heating coils 5*c* and 5*d* and the second inverter circuit board 22*b* placed in the right side thereof perform substantially the same operations. Therefore, in the following description about operations, there will be described only the first inverter circuit board 22*a* and the like which are placed in the left side of the induction heating cooker according to the embodiment 2 with respect to operations thereof, and operations of the second inverter circuit board 22*b* and the like which are placed in the right side thereof will not be described. Note that the external appearance of the induction heating cooker according to the embodiment 2, and the induction heating coils 5*a*, 5*b*, 5*c* and 5*d* and the like therein are substantially the same as those in the aforementioned embodiment 1 and will be described with reference to FIG. 1 and FIG. 2.

At first, the user places to-be-heated objects which are cooking containers such as pans on circle patterns 2*a* and 2*b* (see FIG. 1) indicating heating portions on the top plate 1 in the induction heating cooker according to the embodiment 2. Then, the user sets heating conditions and the like through an operation display portion 3 (see FIG. 1). For example, the user turns on heating switches for the induction heating coils 5*a* and 5*b* (see FIG. 2) corresponding to the circle patterns 2*a* and 2*b*. This activates the high-output inverter circuit 23*a* as the first inverter circuit and the low-output inverter circuit 23*b* as the second inverter circuit, on the first inverter circuit board 22*a*, thereby forming desired high-frequency currents. The respective high-frequency currents created by the high-output inverter circuit 23*a* and the low-output inverter circuit 23*b* are supplied, through the heating-coil terminals 32*a* and 32*b*, to the induction heating coils 5*a* and 5*b* corresponding to the circle patterns 2*a* and 2*b*. This results in the occurrence of high-frequency magnetic fields from the induction heating coils 5*a* and 5*b*, thereby inductively heating the to-be-heated objects such as pans which are placed on the circle patterns 2*a* and 2*b*.

During the induction heating operations as described, the high-frequency current outputted from the heating-coil terminals 32*a* in the high-output inverter circuit 23*a* on the first inverter circuit board 22*a* is created by the switching devices 111*a* and 111*b*, the first passive portion 27*a* constituted by the resonant capacitor 25*a* and the smoothing capacitor 26*a* and the like. Further, the high-frequency current outputted from the heating-coil terminals 32*b* in the low-output inverter circuit 23*b* on the first inverter circuit board 22*a* is created by the switching devices 112*a* and 112*b*, the second passive portion 27*b* constituted by the resonant capacitor 25*b* and the smoothing capacitor 26*b*, and the like.

During induction heating operations, heat is generated from the high-frequency-current creating components, such as the switching devices 111*a*, 111*b*, 112*a* and 112*b*, the resonant capacitors 25*a*, 25*b*, and the smoothing capacitors 26*a*, 26*b*. In the induction heating cooker according to the embodiment 2, the cooling fins 161*a*, 161*b*, 162*a* and 162*b* are mounted on the respective switching devices 111*a*, 111*b*, 112*a* and 112*b* which generate particularly larger amounts of heat, to thereby improve the heat-dissipation performance.

Further, in the induction heating cooker according to the embodiment 2, during induction heating operations, the first cooling blower 17*a* is driven to suck external air through the first suction port 18*a*, and further to blow the external air, as cooling air flows, to the high-output inverter circuit 23*a* and the low-output inverter circuit 23*b*, in the mentioned order. The cooling air flows having thus flown are ejected to outside of the main body through the exhaust port 19 which is shaped to have a larger opening and a smaller ventilation resistance. As described above, the induction heating cooker according to the embodiment 2 is adapted to efficiently apply cooling air flows from the first cooling blower 17*a* to the heat-generating components in the respective inverter circuits 10*a* and 10*b*, whereby operations for cooling the heat-generating components are performed with higher efficiency.

In the induction heating cooker according to the embodiment 2, the duct 30*a* covers the heat-generating components mounted on the first inverter circuit board 22*a*, such as the first cooling fin 111*a*, the second cooling fin 111*b*, the third cooling fin 112*a*, the fourth cooling fin 112*b*, the first passive portion 27*a*, the second passive portion 27*b*, which enables cooling air flows from the first cooling blower 17*a* to be blown surely to the heat-generating components with higher efficiency.

Further, in the induction heating cooker according to the embodiment 2, inside the duct 30*a*, there is provided the partition rib 31*a* for dividing the first inverter circuit board 22*a* into the fin areas and the mounted-component areas. This realizes a configuration capable of blowing a larger amount of cooling air flows (flows in the direction of the arrow Aa in FIG. 9) to the first cooling fin 111*a*, the second cooling fin 111*b*, the third cooling fin 112*a* and the fourth cooling fin 112*b* in the fin areas which dissipate larger amounts of heat. As a matter of course, the remaining cooling air flows (flows in the direction of the arrow Ba in FIG. 9) are sent to the first passive portion 27*a* and the second passive portion 27*b* in the mounted-component areas which dissipate relatively-smaller amounts of heat.

As described above, the first cooling blower 17*a* operates to cool the cooling fins 161*a*, 161*b*, 162*a* and 162*b* and the passive portions 27*a* and 27*b* which are provided on the first inverter circuit board 22*a*. Further, the second cooling blower 17*b* placed in the right side of the outer case 4 is caused to perform the same cooling operations on the cooling fins 163*a*, 163*b*, 164*a* and 164*b* and the passive portions 27*c* and 27*d* which are provided on the second inverter circuit board 22*b*.

As described above, with the configuration of the induction heating cooker according to the embodiment 2, since the ducts 30*a* and 30*b* and the partition ribs 31*a* and 31*b* are provided, it is possible to easily attain cooling designing according to the amount of heat generation from the mounted components, and it is possible to effectively utilize the abilities of the cooling blowers 17*a* and 17*b*. This results in an improvement in the cooling performance of the induction heating cooker according to the embodiment 2 with the simple configuration. This enables fabrication of a cooking apparatus with excellent reliability and high quality, with lower costs.

Further, with the configuration of the induction heating cooker according to the embodiment 2, it is possible to cool the high-output inverter circuits 23*a* and 23*c* and, further it is possible to directly utilize these cooling air flows for cooling the low-output inverter circuits 23*b* and 23*d*. Accordingly, the induction heating cooker according to the embodiment 2 is configured to be capable of utilizing cooling air flows from the cooling blowers 17*a* and 17*b* with higher efficiency without wasting them, thereby providing significant advantages in terms of size reduction and noise reduction in the cooling blowers 17*a* and 17*b*.

As described above, in the induction heating cooker according to the embodiment 2, the high-output inverter circuit 23*a* is configured to include the two switching devices 111*a* and 111*b*, and the low-output inverter circuit 23*b* is configured to include the two switching devices 112*a* and 112*b*. The cooling fins 161*a*, 161*b*, 162*a* and 162*b* are mounted on the respective switching devices 111*a*, 111*b*, 112*a* and 112*b*, and each of the cooling fins 161*a*, 161*b*, 162*a* and 162*b* is electrically independent. Similarly, on the second inverter circuit board 22*b*, the cooling fins 163*a*, 163*b*, 164*a* and 164*b* are mounted on the respective switching devices 113*a*, 113*b*, 114*a* and 114*b*, and each of the cooling fins 163*a*, 163*b*, 164*a* and 164*b* is electrically independent. This eliminates the necessity of electrically insulating the switching devices 111*a*, 111*b*, 112*a*, 112*b*, 113*a*, 113*b*, 114*a* and 114*b* from the cooling fins 161*a*, 161*b*, 162*a*, 162*b*, 163*a*, 163*b*, 164*a* and 164*b*. Therefore, with the configuration of the induction heating cooker according to the embodiment 2, there is no need for providing insulating members for degrading heat conductivity, such as insulation sheets, between the switching devices and the cooling fins, thus resulting in a significant improvement of the cooling performance.

Further, in the induction heating cooker according to the embodiment 2, the cooling fins 161*a*, 161*b*, 162*a* and 162*b* have the same cross-sectional shape orthogonal to substantially-straight cooling air flows from the first cooling blower 17*a*, and further each of the cooling fins 161*a*, 161*b*, 162*a* and 162*b* includes plural protruded fins which are placed in parallel with the cooling air flows. Further, along the substantially-straight cooling air flows from the first cooling blower 17*a*, the second cooling fin 161*b* is placed at a position in the downwind side with respect to the first cooling fin 161*a*, in a longitudinal row. Similarly, the second cooling fin 161*b*, the third cooling fin 162*a* and the fourth cooling fin 162*b* are placed in a longitudinal row in the mentioned order, in the downwind direction. This results in reduction of pressure losses in cooling air flows having passed through the respective cooling fins 161*a*, 161*b*, 162*a* and 162*b* from the first cooling blower 17*a*, which improves the cooling performance. Further, the cooling fins 163*a*, 163*b*, 164*a* and 164*b* are also configured in the same way with respect to the second cooling blower 17*b*, which reduces pressure losses therein, thereby improving the cooling performance.

Further, in the induction heating cooker according to the embodiment 2, the cooling fins each have the same cross-sectional shape, and also have a shape which can be formed by drawing processing, which allows utilization of a common molding die or the like therefor, thereby enabling increase in productivity and reduction in fabrication cost. Further, it is possible to adjust the lengths of the respective cooling fins in a depthwise direction according to the amount of heat generation from the switching devices, which enables easily changing the amounts of heat dissipation from the respective cooling fins. Thus, with the induction heating cooker according to the embodiment 2, it is possible to easily design cooling fins having optimum cooling abilities for the switching devices.

Further, in the induction heating cooker according to the embodiment 2, the high-output inverter circuit 23*a* (or 23*c*) and the low-output inverter circuit 23*b* (or 23*d*) for supplying high-frequency currents to the two induction heating coils 5*a* and 5*b* (or 5*c* and 5*d*) are placed on the single inverter circuit board 22*a* (or 22*b*), which offers the advantage of reduction of the amount of wiring between the circuits, thereby enabling reduction in size of the inverter circuit board 22*a* (or 22*b*).

In the induction heating cooker according to the embodiment 2, the high-output inverter circuits 23*a* and 23*c* are placed near the cooling blowers 17*a* and 17*b*, and also are placed in the upwind side with respect to the low-output inverter circuits 23*b* and 23*d*, and therefore cooling air flows at a lower temperature and with a high velocity immediately after being sucked through the first suction ports 18*a* are blown to the high-output inverter circuits 23*a* and 23*c*. Thus, the cooling performance for the high-output inverter circuits 23*a* and 23*c* is set to be higher than the cooling performance for the low-output inverter circuits 23*b* and 23*d*, which enables efficient cooling, with such appropriate cooling performance, the high-output inverter circuits 23*a* and 23*c* for supplying high-frequency currents to the induction heating coils 5*a* and 5*c* having a maximum output of 3 kW, and the low-output inverter circuits 23*b* and 23*d* for supplying high-frequency currents to the induction heating coils 5*b* and 5*d* having a maximum output of 2 kW, for example.

With the induction heating cooker according to the embodiment 2, the user can use it more easily at its front side, and therefore, the induction heating coils 5*a* and 5*c* with a maximum output of 3 kW, for example, are placed in a front-side area, namely an area closer to the operation display portion 3, while the induction heating coils 5*b* and 5*d* with a maximum output of 2 kW, for example, are placed in a deeper-side area, which can improve the usability for the user (see FIG. 2). As illustrated in FIG. 9, on the respective inverter circuit boards 22*a* and 22*b* in the outer case 4, the low-output inverter circuits 23*b* and 23*d* are placed in a front-side area, while the high-output inverter circuits 23*a* and 23*c* are placed in a deeper-side area. Thus, the placements of the high-output inverter circuits 23*a* and 23*c* and the low-output inverter circuits 23*b* and 23*d* are opposite from the placement of the induction heating coils 5*a*, 5*b*, 5*c* and 5*d*. However, with the configuration of the induction heating cooker according to the embodiment 2, it is possible to easily change the placement of the outputs of the inverter circuit boards 22*a* and 22*b* and the placement of the outputs of the induction heating coils 5*a*, 5*b*, 5*c* and 5*d*, which facilitates electric connections therebetween.

Further, in the induction heating cooker according to the embodiment 2, the common rectifiers 28*a* and 28*b* are shared for supplying DC-power supplies to the high-output inverter circuits 23*a* and 23*c* and the low-output inverter circuits 23*b* and 23*d*, and these rectifiers 28*a* and 28*b* and the switching devices 111*a* and 113*a* in the high-output inverter circuits 23*a* and 23*c* are mounted on the cooling fins 161*a* and 163*a*, respectively. Accordingly, the single rectifier 28*a* (or 28*b*) is configured to be shared for supplying a power supply to the high-output inverter circuit 23*a* (or 23*c*) and the low-output inverter circuit 23*b* (or 23*d*), which can decrease the components and the wiring patterns on the respective inverter circuit boards 22*a* and 22*b*, thereby largely reducing the circuit areas.

Further, in the induction heating cooker according to the embodiment 2, the rectifier 28*a* provided on the first inverter circuit board 22*a* is mounted, together with the switching device 111*a*, on the first cooling fin 161*a*, and is thereby cooled. The first cooling fin 161*a* is provided immediately anterior to the blowing port 33*a* in the first cooling blower 17*a*, and thus is at a position closer to the first cooling blower 17*a* than to the second cooling fin 161*b*, so that the first cooling fin 161*a* has higher cooling performance. Therefore, even though the switching device 111*a* and the rectifier 28*a* are both mounted on the first cooling fin 161*a*, the first cooling fin 161*a* is capable of coping therewith even though it has the same size as that of the second cooling fin 161*b*. Also, even if an attempt is made to improve the cooling performance of the first cooling fin 161*a*, there is no need for forming the first cooling fin 161*a* to have a size significantly larger than that of the second cooling fin 161*b*. As a result thereof, it is possible to reduce the area occupied by the first inverter circuit board 22*a* within the internal space in the outer case 4. Further, since the rectifier 28*a* is mounted on the first cooling fin 161*a*, the rectifier 28*a* can be surely cooled, so that it can exert its rectification function with higher reliability. The same applies to the rectifier 28*b* provided on the second inverter circuit board 22*b*.

Further, in the induction heating cooker according to the embodiment 2, the ducts 30*a* and 30*b* and the partition ribs 31*a* and 31*b* are provided, thereby ensuring paths for blowing cooling air flows. However, even without providing the partition ribs 31*a* and 31*b* and the ducts 30*a* and 30*b*, it is possible to ensure paths for blowing certain amounts of cooling air flows. For example, since the supporting plates 7*a* and 7*b* are placed above the cooling fins, these supporting plates 7*a* and 7*b* prevent the cooling air flows from diffusing upwardly, thereby ensuring spaces for flowing the cooling air flows therethrough. Accordingly, even with the induction heating cooker having this configuration, it is possible to realize a configuration capable of suppressing diffusion of cooling air flows, thereby ensuring preferable cooling performance. Also, the supporting plates 7*a* and 7*b* can be provided with protruding ribs on their surfaces facing to the cooling fins, in order to provide a configuration for guiding cooling air flows. By forming such ribs on the supporting plates 7*a* and 7*b*, it is possible to prevent diffusion of cooling air flows, thereby ensuring further improved cooling performance.

Further, it is also possible to provide only the partition ribs 31*a* and 31*b* without providing the ducts, in order to provide a configuration for guiding cooling air flows from the cooling blowers. Since the supporting plates 7*a* and 7*b* are placed above the cooling-air-flow blowing paths, it is possible to ensure air-blowing paths in such a way as to separate the fin areas and the mounted-component areas, through the partition ribs 31*a* and 31*b*.

Further, the induction heating cooker according to the embodiment 2 is configured to provide the partition ribs 31*a* and 31*b* in the ducts 30*a* and 30*b*, respectively, thereby separating the fin areas in which the cooling fins are provided, from the mounted-component areas in which the passive portions are provided, with no gap interposed therebetween. However, it is also possible to make the lengths of the partition ribs 31*a* and 31*b* in the direction of cooling air flows smaller and, further, to provide the partition ribs 31*a* and 31*b* near the blowing ports 33*a* and 33*b* in the cooling blowers 17*a* and 17*b*, such that greater parts of cooling air flows are blown to the fin areas, than those to the mounted-component area. This can also provide the same effects as those of the induction heating cooker according to the embodiment 2.

In the induction heating cooker according to the embodiment 2, the switching devices adjacent to each other are at different electric potentials on their cooling-fin-mounted surfaces, and each of the inverter circuit boards 22*a* and 22*b* is configured by employing four cooling fins. However, they may be configured by employing three cooling fins. For example, since the switching device 111*a* in the high-output inverter circuit 23*a* and the switching device 112*a* in the low-output inverter circuit 23*b* are at the same electric potential on their cooling-fin-mounted surfaces, it is possible to interchange, in the sequence, the placement of the switching device 111*a* and the placement of the switching device 111*b* in the high-output inverter circuit 23*a*, namely it is possible to place the switching devices, with respect to the first cooling blower 17*a*, such that the switching devices 111*b*, 111*a*, 112*a* and 112*b* are arranged in the mentioned order. As described above, by placing the switching device 111*a* and the switching device 112*a* which are at the same electric potential on their cooling-fin-mounted surfaces, adjacent to each other, and further by mounting these two switching devices 111*a* and 112*a* on the same cooling fin, it is possible to configure the inverter circuit boards 22*a* and 22*b*, by employing three cooling fins. As a matter of course, since the two switching devices are mounted on the same cooling fin, the cooling performance thereof is degraded. To cope therewith, it is necessary to take a measure, such as forming the cooling fin to have a larger size. However, since the respective switching devices are at the same electric potential on their cooling-fin-mounted surfaces, there is no need for providing an insulation member such as an insulation sheet for degrading the thermal conductivity, between these switching devices and the cooling fin.

Further, even with such a configuration which interchanges the placements of switching devices in the sequence and, further, employs a common cooling fin to be shared thereby, as described above, there is employed the basic configuration for blowing cooling air flows from the high-output-inverter circuits 23*a* and 23*c* to the low-output-inverter circuits 23*b* and 23*d* in the induction heating cooker according to the embodiment 2, which enables efficient utilization of cooling air flows, thereby realizing excellent cooling performance for surely cooling the heat-generating components with the cooling air flows.

Note that in the induction heating cookers according to the first and embodiment 2s, the exhaust port 19 is constituted by a single large opening portion, but it can also be constituted by plural holes (openings).

In the induction heating cooker according to the present invention, as described in the first and embodiment 2s, the cooling blowers 17*a* and 17*b* are configured to suck external air through the suction ports 18*a* and 18*b*, further blow air flows to the inverter circuit boards 8*a*, 8*b*, 22*a* and 22*b*, and further discharge the cooling air flows to outside of the main body through the exhaust port 19. However, the cooling blowers 17*a* and 17*b* can also be configured to blow air flows in the opposite direction. For example, the cooling blowers 17*a* and 17*b* can be configured to suck air through the opening of the exhaust port 19 and to discharge air through the openings of the suction ports 18*a* and 18*b*. To cope therewith, it is possible to interchange the positions of the high-output inverter circuits 10*a*, 10*c*, 23*a* and 23*c* and the positions of the low-output inverter circuits 10*b*, 10*d*, 23*b* and 23*d*. Accordingly, in the induction heating cooker according to the present invention, the high-output inverter circuits can be placed near the suction ports for introducing external air therethrough, while the low-output inverter circuits can be placed at positions where they undergo air flows after cooling the high-output inverter circuits.

Further, in the induction heating cooker according to the present invention, as described in the embodiments 1 and 2, the high-output inverter circuit 10*a*, 23*a* and the low-output inverter circuit 10*b*, 23*b* are placed on the same inverter circuit board 8*a*, 22*a*, and also the high-output inverter circuit 10*c*, 23*c* and the low-output inverter circuit 10*d*, 23*d* are placed on the same inverter circuit boards 8*b*, 22*b*. However, in the induction heating cooker according to the present invention, it is also possible to place a high-output inverter circuit and a low-output inverter circuit on different inverter circuit boards. Namely, in the induction heating cooker according to the present invention, the two inverter circuits can be placed in the cooling-air-flow blowing path, such that the high-output inverter circuit which generates a larger amount of heat may be placed near the suction port through which the cooling blower introduces external air, while the low-output inverter circuit which generates a smaller amount of heat may be provided at a position where it undergoes cooling air flows after being blown to the high-output inverter circuit. By placing the inverter circuits as described above, it is possible to obtain the same effects as those of the aforementioned first and embodiment 2.

Note that while the induction heating cooker according to the present invention has been described in the embodiments 1 and 2 with respect to cases where the first inverter circuit is a high-output inverter circuit, and the second inverter circuit is a low-output inverter circuit, the present invention is not limited to this configuration. For example, the present invention can also be applied to cases where the first inverter circuit and the second inverter circuit have the same specifications regarding the maximum output or to cases where the second inverter circuit has a larger maximum output. To cope with such cases, it is possible to adjust the lengths and the shapes of the cooling fins along cooling air flows, which enables providing the same effects.

Further, while the induction heating cooker according to the present invention is configured by employing the four induction heating coils 5*a*, 5*b*, 5*c* and 5*d* such that they are placed bilaterally symmetrically when viewed from the user, as described in the embodiments 1 and 2, the induction heating cooker according to the present invention is not limited to this configuration. The induction heating cooker according to the present invention is configured to include at least two heating coils, and two inverter circuits placed in a longitudinal row in a cooling-air-flow blowing path, such that one of the inverter circuits is placed near a suction port through which a cooling blower introduces external air, while the other inverter circuit is placed at a position where it undergoes cooling air flows after cooling the aforementioned one inverter circuit. The induction heating cooker according to the present invention is configured such that, at a position which undergoes cooling air flows after passing through a cooling fin on one of the inverter circuits, a cooling fin on the other inverter circuit is placed. Further, at a position which undergoes cooling air flows after passing through a passive portion on the aforementioned one inverter circuit, a passive portion in the other inverter circuit is placed.

Further, with the induction heating cooker according to the present invention, in the where there are provided plural inverter circuits in association with respective induction heating coils, these inverter circuits can be placed in a longitudinal row along cooling air flows, thereby increasing the cooling efficiency. For example, in the case where the induction heating cooker includes three inverter circuits, a second inverter circuit can be placed at a position where it undergoes cooling air flows after being blown to a first inverter circuit, and a third inverter circuit can be placed at a position where it undergoes cooling air flows after being blown to the second inverter circuit, which enables efficient cooling of the respective inverter circuits through cooling air flows from the cooling blower.

Note that while the induction heating device according to the present invention has been described as being an induction heating cooker, it is also possible to place plural inverter circuits, in a longitudinal row, along cooling air flows from a cooling blower as a cooling means, in order to increase the cooling efficiency, in an induction heating device having plural heating portions which utilize electromagnetic induction. The technical idea of the present invention can be applied to various types of apparatus for performing induction heating using plural heating portions, and can provide the excellent advantages in facilitation of designing inverter circuit cooling and in improvement of the cooling performance for the inverter circuits.

The induction heating device according to the present invention has a top plate provided on the upper surface of the main body and on which a cooking container can be placed, and includes, under the top plate, plural heating coils for inductively heating a to-be-heated object such as a cooking container. Under the heating coils, there are provided plural inverter circuits, and the plural inverter circuits are constituted by at least a first inverter circuit and a second inverter circuit. Each of the inverter circuits is provided with a switching device, and a passive portion including heat-generating mounted components, such as a resonant capacitor, a smoothing capacitor. The switching device and the passive portion are adapted to create a high-frequency current to be supplied to the induction heating coil. A cooling fin is mounted on the switching device. Inside the main body, there are provided a suction port and an exhaust port and, further, there is provided a cooling fan. The cooling fan is adapted to blow cooling air flows from the suction port to the exhaust port, and the plural inverter circuits are placed in a space through which the cooling air flows are blown. The first inverter circuit is placed in a side closer to the suction port, while the second inverter circuit is provided at a position where it undergoes cooling air flows after being blown to the first inverter circuit. Further, the cooling fin on the second inverter circuit is placed at a position where it undergoes cooling air flows after being blown to the cooling fin on the first inverter circuit, and the passive portion in the second inverter circuit is placed at a position where it undergoes cooling air flows after being blown to the passive portion in the first inverter circuit.

With the induction heating device having the aforementioned configuration according to the present invention, there is no need for striking a balance between cooling air flows for heat-dissipation members juxtaposed to each other, which has induced problems in the configurations of conventional induction heating cookers. This makes it easier to perform cooling designing, and also improves the cooling performance. Namely, in general, larger amounts of heat are generated from the fin areas in which there are placed the cooling fins on which switching devices are mounted, while smaller amounts of heat are generated from the mounted-component areas including heat-generating components such as resonant capacitors, smoothing capacitors.

Accordingly, in the first inverter circuit and the second inverter circuit which are capable of generating higher outputs and lower outputs, respectively, the fin areas and the mounted-component areas are broadly separated from each other in two systems. Therefore, in blowing cooling air flows from the cooling blower to the first inverter circuit and the second inverter circuit, it is possible to adjust the air-volume balance therebetween, such that cooling air flows with a larger air volume are flowed to the fin areas, while cooling air flows with a smaller air volume are flowed to the mounted-component area. This enables easily designing of cooling the first inverter circuit and the second inverter circuit with a preferable balance. Further, it is possible to directly utilize, for cooling the second inverter circuit, cooling air flows after cooling the first inverter circuit. Therefore, with the induction heating device according to the present invention, it is possible to eliminate wasting of cooling air flows, thereby providing significant advantages in terms of size reduction and noise reduction in the cooling fan.

Further, in the induction heating device according to the present invention, the cooling fin on the first inverter circuit is separated from the cooling fin on the second inverter circuit. This prevents heat generation (heat losses) from the switching device in the first inverter circuit and heat generation (heat losses) from the switching device in the second inverter circuit from directly affecting each other through the same cooling fin. Therefore, there is no factor which obstructs the cooling of the switching devices by the cooling fins. With conventional configurations adapted to mount switching devices in different inverter circuits on a single common cooling fin, if the plural switching devices mounted on the common cooling fin are driven concurrently, generated heat (lost heat) from the respective switching devices is dissipated from the same cooling fin, which causes heat therefrom to affect each other, thereby significantly degrading the cooling ability.

Further, in the case where the switching device in the first inverter circuit and the switching device in the second inverter circuit are at different electric potentials, if a common cooling fin made of a metal is employed therefor, there is a need for taking a measure therefor, such as insulating the switching devices from the cooling fin. However, in the induction heating device according to the present invention, the cooling fin on the first inverter circuit is separated from the cooling fin on the second inverter circuit, which eliminates the necessity of taking account of the insulation between the switching devices and the cooling fins. For example, with the induction heating device according to the present invention, it is not necessary to take a measure for insulation, such as inserting insulation sheets between the switching devices and the cooling fins. If insulation sheets are provided between the switching devices and the cooling fins, this will degrade the heat conduction therebetween, thereby degrading the cooling performance. However, in the induction heating device according to the present invention, the respective switching devices are mounted on the individual independent cooling fins, which eliminates the necessity of providing an insulating member such as an insulation sheet, thereby improving the cooling ability.

In the induction heating device according to the present invention, a common rectifier is provided for both of the first inverter circuit and the second inverter circuit, and this rectifier is mounted on the cooling fin on which the switching device in the first inverter circuit is mounted. Thus, in the induction heating device according to the present invention, the common rectifier is employed for the first and second inverter circuits, which can decrease the circuit components and the wiring patterns, thereby enabling reduction of the circuit areas. Further, since the first inverter circuit is closer to the suction port than the second inverter circuit is, cooling air flows at a lower temperature are flowed through the first inverter circuit, thereby facilitating the improvement of the cooling performance of the cooling air flows. Accordingly, even though the rectifier is mounted on the cooling fin in the first inverter circuit, together with the switching device, it is possible to ensure sufficient cooling performance necessary for dissipating, from this cooling fin, the amount of heat generated from the switching device and the rectifier.

The induction heating device according to the present invention includes a common power-supply circuit for supplying electric power to the first inverter circuit and the second inverter circuit. Therefore, it is possible to preliminarily set a maximum value of the total output constituted by the output of the first inverter circuit and the output of the second inverter circuit, and further to allocate the total output as the output of the first inverter circuit and the output of the second inverter circuit. Thus, for example, if the output of the first inverter circuit is to be increased, the output of the second inverter circuit is decreased. As described above, with the induction heating device according to the present invention, it is possible to set the total amount of heat generation from the first and second inverter circuits to be equal to or less than a certain value. As a result thereof, the induction heating device according to the present invention is allowed to have reduced cooling performance, thereby enabling reduction of the sizes of the cooling blower and the inverter circuits, for example.

In the induction heating device according to the present invention, the power-supply circuit is provided at a position near the cooling blower, and also at a place where the power-supply circuit does not directly undergo cooling air flows toward the plural inverter circuits. Since the power-supply circuit is constituted by components which generate relatively-smaller amounts of heat, the power-supply circuit is not required to be cooled. Therefore, it is possible to effectively utilize a space which is less prone to be cooled, thereby enabling the placement of the power-supply circuit in a space where it does not directly undergo cooling air flows. By placing the power-supply circuit board at a position near the cooling blower in a space with leeway, it is possible to effectively place the respective components within the capacity of the main body having predetermined sizes, thereby improving the mountability for circuits. Particularly, in the case where the main body is designed to have a smaller thickness, it is significantly important to efficiently configure the places at which circuits are placed. The present invention is effective particularly in such cases of smaller thicknesses.

In the induction heating device according to the present invention, a duct covers at least portions of the first inverter circuit and the second inverter circuit, and cooling air flows from the cooling blower pass through the duct, so that cooling air flows from the cooling blower can be effectively blown to the respective inverter circuits, which can improve the cooling performance.

In the induction heating device according to the present invention, inside the duct, there is provided a partition rib for dividing cooling air flows being blown to the cooling fins and the passive portions in the inverter circuits, which facilitates allocating a larger amount of cooling air flows to the cooling fins which generate larger amounts of heat, thereby improving the cooling performance.

In the induction heating device according to the present invention, the respective cooling fins have substantially the same cross-sectional shape orthogonal to cooling air flows, which makes air flows constant throughout the respective cooling fins, thereby reducing pressure losses in the cooling air flows passing through the cooling fins, and thus improving the cooling performance.

In the induction heating device according to the present invention, the first inverter circuit and the second inverter circuit are configured to include two switching devices in a high-voltage side and a low-voltage side, different cooling fins are mounted on the respective switching devices, and the respective cooling fins are arranged on a single substantially-straight line along cooling air flows. Along cooling air flows, in the following order, the cooling fin on the high-voltage-side switching device in the first inverter circuit is placed at a position closest to the suction port, next, the cooling fin on the low-voltage-side switching device in the first inverter circuit is placed, next, the cooling fin on the high-voltage-side switching device in the second inverter circuit is placed and, next, the cooling fin on the low-voltage-side switching device in the second inverter circuit is placed. Since the cooling fins are placed as described above, and the respective switching devices are mounted on the different cooling fins, it is possible to design the shapes of the cooling fins, such as the sizes thereof, according to the amounts of heat generation from the respective switching devices. Further, since the respective switching devices are provided on the different independent fins, it is not necessary to take account of insulation between the switching devices and the cooling fins. As a result thereof, with the configuration of the induction heating device according to the present invention, there is no need for inserting insulating members such as insulation sheets, between the switching devices and the cooling fins, which prevents degradation of the heat conductivity between the switching devices and the cooling fins, thereby improving the cooling performance.

INDUSTRIAL APPLICABILITY

With the present invention, it is possible to facilitate designing of cooling of inverter circuits, and further it is possible to improve the cooling performance of an induction heating cooker having plural heating portions. Therefore, the present invention can be applied to various types of apparatuses for performing induction heating, and thus has excellent general versatility.

The invention claimed is:

1. An induction heating device comprising:

a top plate on which a to-be-heated object is allowed to be placed;

plural induction heating coils for inductively heating the to-be-heated object, the induction heating coils being placed just under the top plate;

plural inverter circuit boards for supplying high-frequency currents to the plural induction heating coils, respectively and comprising plural inverter circuits mounted thereon; and cooling portions comprising a blowing port for blowing cooling air to the plural inverter circuit boards, each blowing port associated with and corresponding to each inverter circuit board;

wherein the plural inverter circuits on each inverter circuit board are placed under the plural induction heating coils with an air-flow blowing path formed there between and cooling air flows from each cooling portion through the air-flow blowing path space, the plural inverter circuits on each inverter circuit board arranged side by side forming a longitudinal row and the cooling air flowing along the longitudinal row of the plural inverter circuits, wherein each of the plural inverter circuits comprises:

a fin area having a cooling fin on which at least a switching device is mounted, and a mounted-component area provided with a heat-generating mounted component to be directly cooled by the cooling air flows, wherein the fin area and the mounted-component area are separated from each other in each inverter circuit, and wherein fin areas of the plural inverter circuits are arranged side by side to form a longitudinal row of the fin areas in each inverter circuit board and mounted-component areas of the plural inverter circuits are arranged side by side to form a longitudinal row of the mounted-component areas in each inverter circuit board, wherein the blowing port corresponding to each inverter circuit board is arranged to send cooling air directly both to the longitudinal row of the fin areas and the longitudinal row of the mounted-component areas through a respective air-flow blowing path formed in the fin areas and the mounted-component areas;

wherein the cooling air having passed through one of the fin area continues to flow through the longitudinal row of the remaining fin areas in a first cooling path, and the cooling air having passed through one of the mounted-component areas continues to flow through the longitudinal row of the remaining mounted-component areas in a second cooling path, respectively, the longitudinal row of the fin areas being spaced apart and separated from the longitudinal row of the mounted-component areas such that the first cooling path and the second cooling path are separated from each other in each inverter circuit board, and the cooling air flowing in the first cooling path has a volume larger than a volume of the cooling air flowing in the second cooling path, wherein the cooling air flowing in the first cooling path and the cooling air flowing in the second cooling path flow in the same direction.

2. The induction heating device according to claim 1, wherein:

the plural inverter circuits comprise a first inverter circuit for supplying a high-frequency current to an induction heating coil having a larger maximum output, and a second inverter circuit for supplying a high-frequency current to an induction heating coil having a smaller maximum output, the first inverter circuit is provided closer to the corresponding blowing port in the cooling portion than to the second inverter circuit, the first inverter circuit is placed in an upwind side with respect to the second inverter circuit, and the cooling air flowing from the cooling portion passes through the second inverter circuit, after passing through the first inverter circuit.

3. The induction heating device according to claim 2, wherein the plural inverter circuits are provided with each of switching devices mounted on different cooling fins, and the cooling air flowing from the cooling portion pass through the cooling fin on which the switching device in the second inverter circuit is mounted, after passing through the cooling fin on which the switching device in the first inverter circuit is mounted.

4. The induction heating device according to claim 1, wherein the plural inverter circuits each include a cooling fin on which at least a switching device is mounted, and a rectifier for supplying a power supply to the plural inverter circuits is mounted on the cooling fin of the inverter circuit provided most closely to a blowing port in the cooling portion.

5. The induction heating device according to claim 1, wherein:

the plural inverter circuits comprise a first inverter circuit and a second inverter circuit, the first inverter circuit being placed in an upwind side with respect to the second inverter circuit in a longitudinal row, the induction heating device includes a power-supply circuit for supplying electric power to each of the first inverter circuit and the second inverter circuit, and a control circuit for controlling the electric power supplied to each of the first inverter circuit and the second inverter circuit, and the control circuit is adapted such that a total output value constituted by an output of the first inverter circuit and an output of the second inverter circuit is preliminarily set, and is adapted to perform control for allocating an output within the total output value, as the output of the first inverter circuit and the output of the second inverter circuit.

6. The induction heating device according to claim 1, wherein a power-supply circuit for supplying electric power to each of the plural inverter circuits is juxtaposed to the cooling portion and is placed at a place where the power-supply circuit does not directly undergo the cooling air flowing from the cooling portion.

7. The induction heating device according to claim 1, wherein the plural inverter circuits placed in a longitudinal row are covered with a duct or at least at portions thereof, and cooling air flowing from the cooling portion are blown through the duct.

8. The induction heating device according to claim 1, wherein each inverter further comprises a partition rib for separating the cooling air passing through the fin area in the first cooling path from the cooing air passing through the mounted-component area in the second cooling path.

9. The induction heating device according to claim 1, wherein each of the cooling fins provided in the plural inverter circuits is shaped to have substantially the same cross-sectional shape orthogonal to the first cooling path of the cooling air flowing from the cooing portion.

10. The induction heating device according to claim 1, wherein the plural inverter circuits comprise a first inverter circuit and a second inverter circuit, the inverter circuits are each configured to create a high-frequency current using two switching devices in a high-voltage side and a low-voltage side, different cooling fins are mounted on the respective switching devices, and the respective cooling fins of the first and second inverter circuits are placed side by side to form a longitudinal row of the cooling fins and the first cooling path forms a substantially straight line path, the cooling air passes first the cooling fin mounted on the high-voltage-side switching device in the first inverter circuit which is placed at a position closest to a blowing port of the cooling portion, and then, sequentially passes the cooling fin mounted on the low-voltage-side switching device in the first inverter circuit, the cooling fin mounted on the high-voltage-side switching device in the second inverter circuit, and the cooling fin mounted on the low-voltage-side switching device in the second inverter circuit which is placed at a position farthest from the blowing port of the cooling portion.

* * * * *